US009181049B2

(12) United States Patent
Takada

(10) Patent No.: US 9,181,049 B2
(45) Date of Patent: Nov. 10, 2015

(54) MEDIUM INTAKE DEVICE

(71) Applicant: Oki Electric Industry Co., Ltd., Tokyo (JP)

(72) Inventor: Atsushi Takada, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/376,418

(22) PCT Filed: Mar. 7, 2013

(86) PCT No.: PCT/JP2013/056360

§ 371 (c)(1),
(2) Date: Aug. 1, 2014

(87) PCT Pub. No.: WO2013/150860

PCT Pub. Date: Oct. 10, 2013

(65) Prior Publication Data

US 2014/0374986 A1 Dec. 25, 2014

(30) Foreign Application Priority Data

Apr. 6, 2012 (JP) ..... 2012-087216

(51) Int. Cl.
*B65H 1/10* (2006.01)
*B65H 1/12* (2006.01)
(Continued)

(52) U.S. Cl.
CPC .. *B65H 1/06* (2013.01); *B65H 1/12* (2013.01); *B65H 1/14* (2013.01); *B65H 1/24* (2013.01);
(Continued)

(58) Field of Classification Search
CPC ..... B65H 1/04; B65H 1/06; B65H 1/08; B65H 1/10; B65H 1/12; B65H 1/14; B65H 1/26; B65H 11/02; B65H 2405/10; B65H 2405/11; B65H 2405/111; B65H 2405/1115; B65H 2405/11152; B65H 3/063; B65H 1/24; B65H 2701/1912; G07D 11/0018; G07D 11/0021
See application file for complete search history.

(56) References Cited

U.S. PATENT DOCUMENTS 4,305,577 A * 12/1981 Clay et al. ..... 271/119
4,971,310 A * 11/1990 Motegi et al. ..... 271/126
(Continued)

FOREIGN PATENT DOCUMENTS

| | | | |
|---|---|---|---|
| JP | H06-92479 | A | 4/1994 |
| JP | 2005-212910 | A | 8/2005 |
| JP | 2011-180993 | A | 9/2011 |
| WO | WO-2011/078177 | A1 | 6/2011 |

*Primary Examiner* — Prasad Gokhale
(74) *Attorney, Agent, or Firm* — Rabin & Berdo, P.C.

(57) ABSTRACT

A lower pressure plate (43) is disposed upon a paper currency pressing part (34) of a paper currency intake part (5) below an upper pressure plate (41) with a spring (44) interposed therebetween, and the paper currency pressing part (34) presses the lower pressure plate (43) upon stacked paper currency (BLC). Thus, when the stacked paper currency (BLC) oscillates vertically with the rotation of a picker roller (23), the paper currency pressing part (34) absorbs by the spring (44) an upward force which is applied from the stacked paper currency (BLC). Furthermore, the paper currency pressing part (34) presses the lower pressure plate (43) by a restoring force of the spring (44) with respect to the falling stacked paper currency (BLC). Accordingly, the paper currency pressing part (34) continues to make the lower pressure plate (43) make contact with the uppermost part of the stacked paper currency (BLC), allowing the intake of the paper currency (BL) to continue without misalignment of the paper currency in the stacked paper currency (BLC) to occur.

19 Claims, 27 Drawing Sheets

(51) Int. Cl.

| | |
|---|---|
| ***B65H 1/06*** | (2006.01) |
| ***G07D 11/00*** | (2006.01) |
| ***B65H 3/06*** | (2006.01) |
| ***B65H 1/14*** | (2006.01) |
| ***B65H 1/24*** | (2006.01) |

(52) U.S. Cl.

CPC ..... *B65H 3/063* (2013.01); *G07D 11/0018* (2013.01); *G07D 11/0021* (2013.01); *B65H 2701/1912* (2013.01)

(56) References Cited

U.S. PATENT DOCUMENTS

| | | | | |
|---|---|---|---|---|
| 8,210,523 | B2 * | 7/2012 | Maekawa et al. | 271/126 |
| 8,708,327 | B2 * | 4/2014 | Suzuki et al. | 271/23 |
| 8,894,062 | B1 * | 11/2014 | Chen et al. | 271/137 |
| 2011/0049788 | A1 * | 3/2011 | Suzuki et al. | 271/145 |
| 2012/0279173 | A1 | 11/2012 | Sakoguchi et al. | |
| 2015/0001788 | A1 * | 1/2015 | Aoki et al. | 271/147 |

* cited by examiner

MEDIUM INTAKE DEVICE

TECHNICAL FIELD

The present invention relates to a media feeding device and is, for example, suitably applied to a currency bill processing device that feeds stacked currency bills, counts the currency bills, and straps every predetermined number of the currency bills to thereby process the currency bills.

BACKGROUND ART

Conventionally, teller machines used in financial institutions count currency bills according to their denominations and stack the counted currency bills in plural temporary stacking units. Additionally, as an example of such a teller machine, teller machines having a built-in currency bill processing device, which straps every certain number of the currency bills to thereby process the currency bills, are widely used.

As a currency bill processing device, for example, a currency bill processing device has been proposed which, when numerous currency bills are set in a stacked state in a currency bill feeder, separates and feeds the currency bills one at a time and discriminates the denomination and fitness of the currency bills (e.g., see Japanese Patent Application Laid-open (JP-A) No. 2005-212910 (FIG. 2 etc.)). This currency bill processing device stacks the currency bills in temporary stacking units on the basis of the denomination and fitness discrimination results, and when the number of the stacked currency bills reaches a certain number, the device straps the currency bills together with a strap and discharges the strapped currency bills.

Regarding the currency bill feeder in the currency bill processing device, there is, for example, a currency bill feeder where rollers are built into a stage on which the currency bills are placed and where picker portions that are raised from, and whose frictional force is higher than, surrounding portions are disposed on parts of peripheral side surfaces of the rollers. In this currency bill feeder, the currency bills are pressed by a pressing member (a holding plate) from above the stacked currency bills.

Additionally, in this currency bill feeder, the currency bills are stacked on the stage and pressed against the stage by the holding plate, and the rollers are rotated so that the currency bills in the lowermost layer are separated one at a time. Because of this, the currency bill feeder can sequentially feed the currency bills into the currency bill processing device.

DISCLOSURE OF INVENTION

Technical Problem

In this connection, in the currency bill feeder having this configuration, guides that guide or support the currency bills are formed on the right and left sides and on the far side of a space in which the currency bills are to be stacked. At the same time, in the currency bill feeder, the near side of the space is open to a great extent so that currency bills can be added at any time.

For this reason, in the currency bill feeder, there has been the concern that when the number of the stacked currency bills becomes greater, the currency bills will end up collapsing on the near side.

Therefore, there is a currency bill feeder where the stage is inclined in such a way that its near side is higher, so that the currency bills tend to lean against the far side where one of the guides is formed and do not collapse on the near side. In this case, the holding plate that presses the currency bills against the stage from above is also inclined in such a way that its near side is higher.

In the currency bill feeder, the picker portions are raised from the peripheral side surfaces of the rollers, so due to the rotation of the rollers an upward kicking force acts on the currency bills and the holding plate positioned on the upper side of the currency bills. As a result, the currency bills and the holding plate end up vibrating up and down.

At this time, in the currency bill feeder, because the masses and the magnitudes of the moments of inertia of the currency bills and the holding plate differ from one another, the timings when the currency bills and the holding plate go from ascending to descending do not coincide with one another, and the currency bills and the holding plate end up temporarily separating from one another.

Particularly in a case where the stage and the holding plate are inclined in such a way that their near sides are higher, in the currency bill feeder, while the currency bills are temporarily separated from the holding plate, the currency bills in the uppermost portion of the stacked currency bills move in such a way that they slide toward the near side along the inclination of the holding plate. Additionally, sometimes the currency bills in the uppermost portion of the stacked currency bills remain the way they are without returning to the far side—that is, with parts of the currency bills sticking out on the near side—and are pressed downward by the holding plate.

For this reason, the conventional currency bill feeder has had the problem that as it repeatedly feeds the currency bills, the uppermost portion of the stacked currency bills gradually ends up sticking out on the near side, and before long the currency bills end up collapsing on the near side from the uppermost portion.

The present invention has been made in consideration of the above point and proposes a media feeding device that can sequentially feed stacked media without causing the media to collapse.

Solution to Problem

In order to solve this problem, a media feeding device of the present invention includes: a floor guide on which paper sheet-like media are stacked and placed and which is inclined in such a way that a feed direction side thereof that feeds the media in the lowermost portion of the stack is lower; rollers, each of which has a roller base portion formed in a substantially cylindrical shape and a picker portion that is disposed on part of a peripheral side surface of the roller base portion and causes frictional force to act on the media, with the rollers rotating in such a way that the picker portions project toward the stacked media from a lower side of picker holes formed in the floor guide; a mask guide that supports the stacked media on the feed direction side of the floor guide; a pressing member that has a predetermined mass and utilizes the force of gravity to press the stacked media against the floor guide; an auxiliary pressing member that is interposed between the pressing member and the stacked media; and absorbing members that absorb force applied to the auxiliary pressing member from the media.

Because of this, in the media feeding device of the present invention, the picker portions periodically kick up, in accompaniment with the rotation of the rollers, the media stacked on the floor guide. Additionally, in the media feeding device of the present invention, when vibration caused by the kicking-up of the media is transmitted to the auxiliary pressing member, the absorbing members absorb this vibration to allow the auxiliary pressing member to follow the uppermost portion of the media. For this reason, in the media feeding device of the present invention, the media can be prevented from sticking out.

Advantageous Effects of Invention

According to the present invention, the picker portions periodically kick up, in accompaniment with the rotation of the rollers, the media stacked on the floor guide. Additionally, in the present invention, when vibration caused by the kicking-up of the media is transmitted to the auxiliary pressing member, the absorbing members absorb this vibration to allow the auxiliary pressing member to follow the uppermost portion of the media. For this reason, according to the present invention, the media can be prevented from sticking out. In this way, the present invention can realize a media feeding device that can sequentially feed stacked media without causing the media to collapse.

BEST MODES FOR CARRYING OUT THE INVENTION

Modes for carrying out the invention (hereinafter called embodiments) will be described below using the drawings.

[1. First Embodiment]

[1-1. Configuration of Currency Bill Processing Device]

Figure 1:
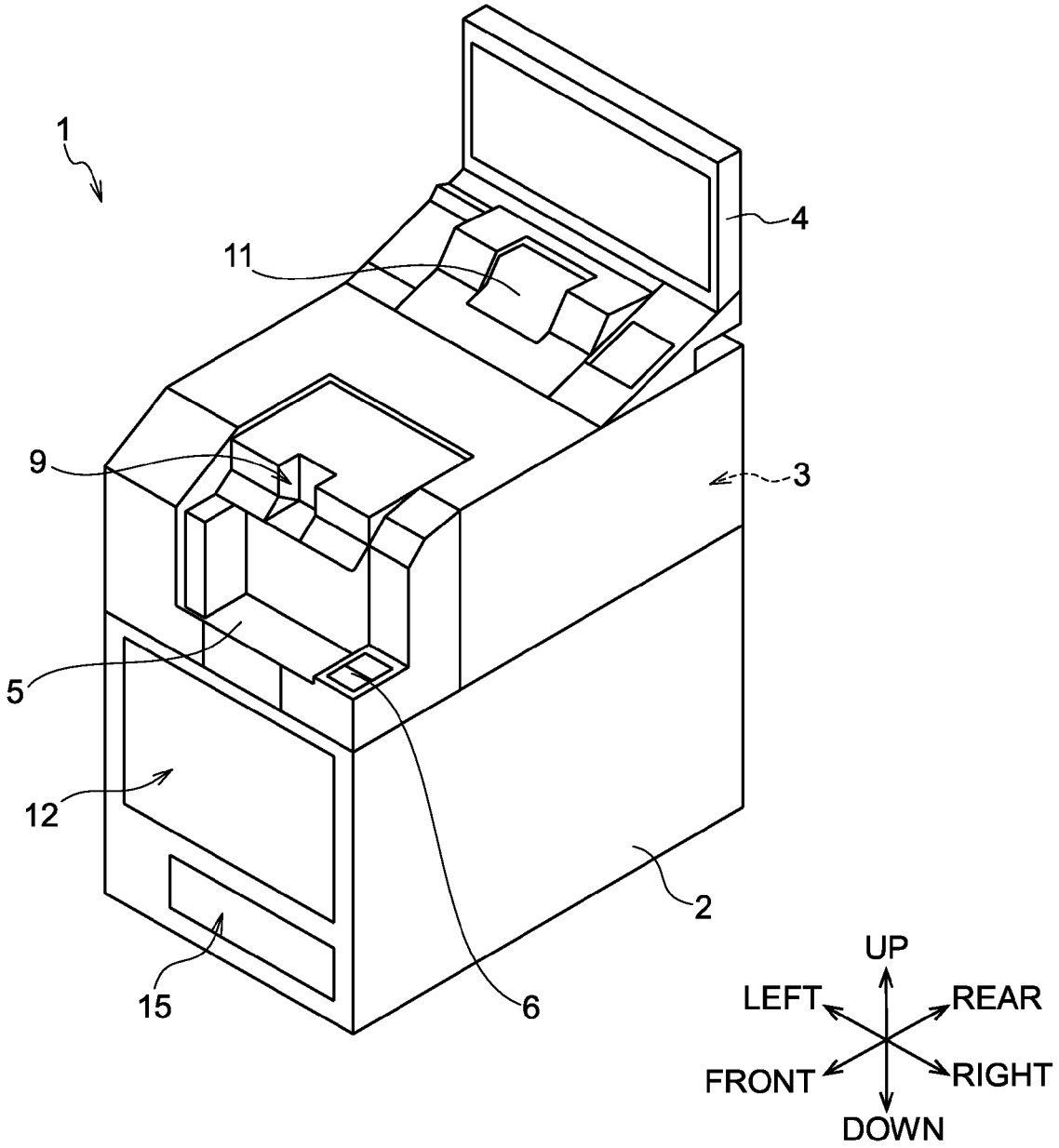
FIG. 1 is a perspective view schematically showing the configuration (1) of a currency bill processing device.
Figure 2:
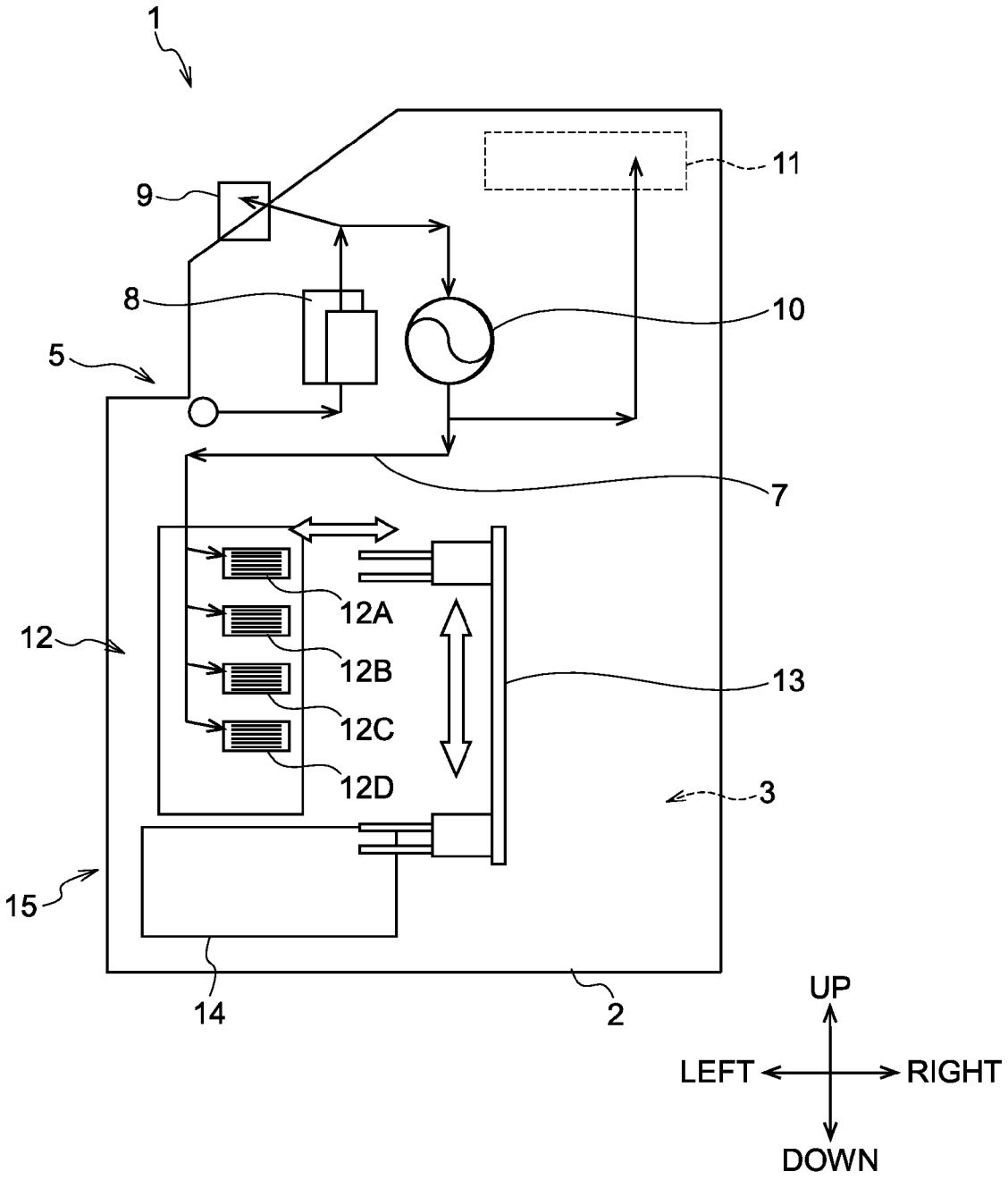
FIG. 2 is a side view schematically showing the configuration (2) of the currency bill processing device.

As shown in FIG. 1 and FIG. 2, a currency bill processing device 1 counts currency bills serving as an example of media and straps every predetermined number of the currency bills to thereby process the currency bills.

Furthermore, the currency bill processing device 1 is installed in a cash center of a financial institution, for example, and executes currency bill processing in accordance with operations by an employee (hereinafter called an operator) of the financial institution.

The currency bill processing device 1 has a variety of mechanisms built inside a casing 2 configured in a cuboid shape, and these mechanisms are integrally controlled by a control unit 3. The control unit 3 is configured around a non-illustrated central processing unit (CPU). Additionally, the control unit 3 performs currency bill counting and strapping by reading and executing a predetermined program from a non-illustrated ROM or flash memory.

An operation and display unit 4 comprising an integrated liquid crystal display (LCD) that displays various screens and a touch panel that accepts input operations from the operator is attached to the rear side of the upper portion of the casing 2. The operation and display unit 4 displays predetermined operation screens, allows the operator to designate operating modes and set the denominations and stacking order of the currency bills to be counted, and notifies the control unit 3 of the details of those settings.

Hereinafter, the direction heading toward the front faced by the operator will be defined as a front direction, and the opposite direction will be defined as a rear direction. Moreover, description will be given with the right and left direction and the up and down direction being defined as directions seen from the standpoint of the operator when facing the front side of the currency bill processing device 1.

A currency bill feeder 5 serving as an example of a media feeding device that feeds the currency bills is disposed in the upper portion of the front side of the casing 2. When the currency bills are stacked and an operation button 6 is operated by the operator, the currency bill feeder 5 separates and feeds the currency bills one at a time into the currency bill processing device 1 to thereby deliver the currency bills to a conveyor 7 (see FIG. 2).

As shown in FIG. 2, the conveyor 7 employs combinations of non-illustrated rollers, belts, and currency bill guides to form a conveyance path that joins each section. Additionally, the conveyor 7 conveys the currency bills to each section along the conveyance path on the basis of control by the control unit 3.

Specifically, when the currency bills are delivered from the currency bill feeder 5 to the conveyor 7, the conveyor 7 conveys the currency bills to a discriminating unit 8. As the currency bills are conveyed inside the discriminating unit 8, the discriminating unit 8 discriminates the denominations, authenticity, front and back sides, and extent of damage to the currency bills and notifies the control unit 3 of the discrimination results.

Then, the control unit 3 decides where to convey the currency bills and counts the currency bills on the basis of the acquired discrimination results. At this time, if a currency bill whose denomination could not be identified or a conveyance abnormality is detected, the control unit 3 has the conveyor 7 convey the currency bill discriminated as abnormal to a reject pocket 9.

The reject pocket 9 is disposed in such a way that part of it is exposed above the currency bill feeder 5 in the casing 2. Furthermore, the reject pocket 9 stacks the currency bills conveyed thereto by the conveyor 7 to allow the operator to remove them.

Furthermore, the control unit 3 makes the conveyor 7 convey the currency bills discriminated as normal to a front/back rotating unit 10. The front/back rotating unit 10 rotates the front and back sides of the currency bills for which the discrimination result in the discriminating unit 8 was either one of "front side" or "back side" to thereby cause the front and back sides of all of the currency bills to face the same way and delivers the currency bills back to the conveyor 7.

Then, the control unit 3 conveys to an open pocket 11 the currency bills that were discriminated as normal but are not to undergo strapping described later. The open pocket 11 is disposed in such a way that part of it is exposed in front of the operation and display unit 4 (see FIG. 1) in the upper portion of the casing 2. Additionally, like the reject pocket 9, the open pocket 11 stacks the currency bills conveyed thereto by the conveyor 7 to allow the operator to remove them.

The types of the currency bills to undergo strapping can be set via the operation and display unit 4.

The control unit 3 conveys to a stacking mechanism 12 the currency bills that were discriminated as normal and are to undergo strapping. The stacking mechanism 12 has four temporary stacking units 12A, 12B, 12C, and 12D (hereinafter indicated as 12A to 12D) that are disposed adjacent to one another in the up and down direction. Additionally, the stacking mechanism 12 conveys in the up and down direction the currency bills delivered thereto from the conveyor 7, delivers the currency bills to any of the temporary stacking units 12A to 12D, and stacks the currency bills.

The stacking mechanism 12 stacks the currency bills in any of the temporary stacking units 12A to 12D in accordance with the discrimination results in the discriminating unit 8 on the basis of control by the control unit 3. As a result, the currency bills that have been sorted according to a preset condition such as denomination are stacked in the temporary stacking units 12A to 12D of the stacking mechanism 12.

The control unit 3 counts the number of the stacked currency bills in each of the temporary stacking units 12A to 12D of the stacking mechanism 12. Then, when the number of the stacked currency bills reaches a preset strap limit—such as one hundred bills, for example—the control unit 3 instructs a transfer unit 13 to transfer the currency bills.

The transfer unit 13 is disposed behind the stacking mechanism 12 and rearwardly removes the currency bills stacked in the temporary stacking units 12A to 12D. Additionally, the transfer unit 13 also moves the currency bills downward to thereby deliver the currency bills to a currency bill strapping unit 14 disposed under the stacking mechanism 12.

The currency bill strapping unit 14 creates a bill bundle by using a strapping member such as paper tape to strap the one hundred currency bills transferred thereto by the transfer unit 13. Additionally, the currency bill strapping unit 14 sends the bill bundle to an outlet 15.

The outlet 15 is disposed in the lower portion of the front surface of the casing 2 and allows the operator to remove the created bill bundle.

In this way, the currency bill processing device 1 feeds, one at a time, the currency bills stacked in the currency bill feeder 5 and sorts the currency bills according to their denominations and so forth. Additionally, the currency bill processing device 1 straps the sorted currency bills each time the strap limit—such as one hundred bills—is reached and sequentially creates bill bundles.

[1.2 Configuration of Currency Bill Feeder]

Figure 3:
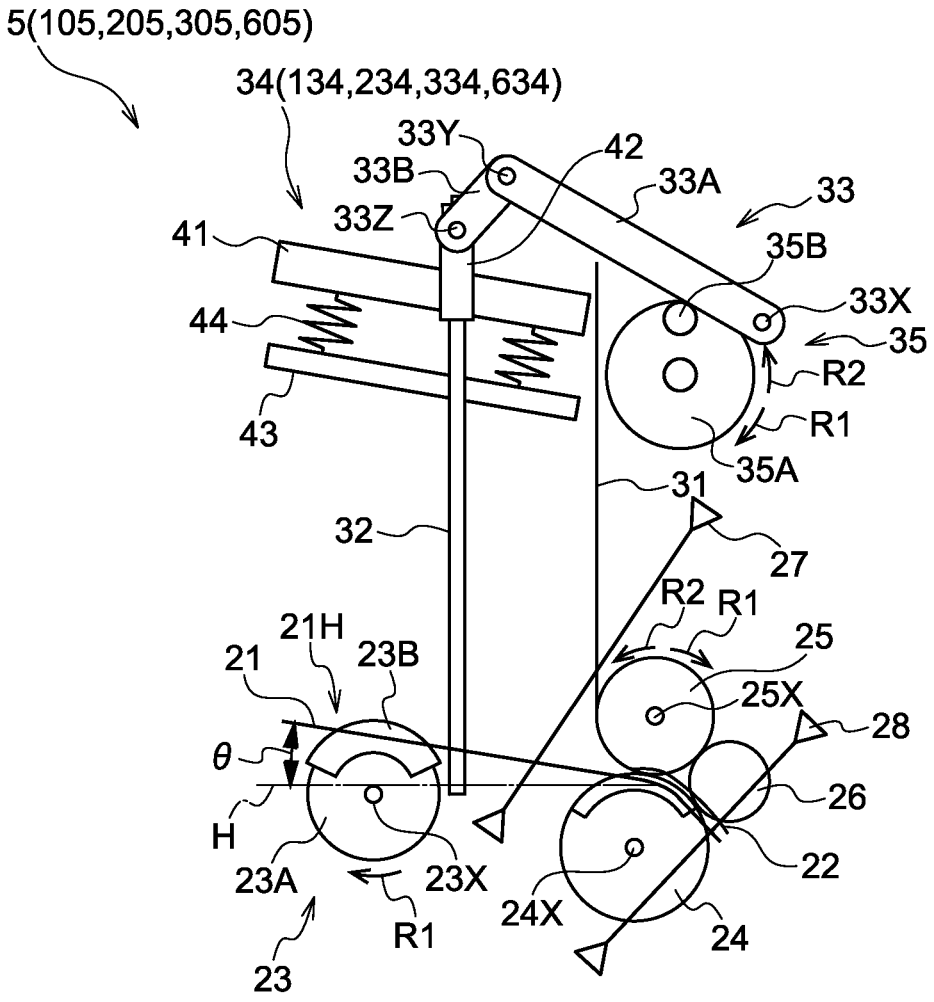
FIG. 3 is a schematic view showing the configuration of a currency bill feeder.

As shown in FIG. 3, the currency bill feeder 5 stacks currency bills BL in a stacking space formed by a floor guide 21 and a mask guide 31.

The mask guide 31 has a front surface that is substantially vertical and is of a sufficient length in the up and down direction. Additionally, the mask guide 31 supports the currency bills stacked on the floor guide 21 in such a way that the currency bills do not fall over rearward.

Slide shafts 32 are formed in a long and narrow cylindrical shape and, like the mask guide 31, have a sufficient length in the up and down direction. Furthermore, the slide shafts 32 are installed on the right and left sides of the floor guide 21 in such a way that their central axes are substantially vertical.

Arm links 33 each comprising two arms 33A and 33B linked together are disposed above the mask guide 31.

The arms 33A are rotatably attached, at their end portions on the rear side of the currency bill feeder 5, to a body of the currency bill feeder 5 by a rotating shaft 33X. Additionally, the arms 33A are rotatably attached, at their end portions on the front side of the currency bill feeder 5, to the arms 33B via a rotating shaft 33Y.

The arms 33B are attached, at their end portions on the rear side of the currency bill feeder 5, to the rotating shaft 33Y. Additionally, a currency bill holder 34 is disposed, via a rotating shaft 33Z, on the end portions of the arms 33B on the front side that is the opposite side.

The currency bill holder 34 moves in the up and down direction along the slide shafts 32 and uses its own weight to press the currency bills BL stacked in the stacking space (see FIG. 12) against the floor guide 21 (this will be described in detail below). Hereinafter, the currency bills BL stacked in the stacking space will be called stacked currency bills BLC (see FIG. 12).

Furthermore, a stopper gear 35 is disposed under and near the rear side of the arms 33A. The stopper gear 35 comprises a discoid disc portion 35A whose plate surface faces rightward and a short cylindrical stopper pin 35B disposed upright on the disc portion 35A. Additionally, the disc portion 35A and the stopper pin 35B of the stopper gear 35 are integrally rotated on the basis of control by the control unit 3.

When the disc portion 35A of the stopper gear 35 is rotated in the direction of arrow R1, the stopper pin 35B is brought into contact with the lower surface of the arm 33A and pushes up the arm 33A. Furthermore, when the disc portion 35A of the stopper gear 35 is rotated in the direction of arrow R2, the stopper pin 35B is separated downward from the lower surface of the arm 33A.

That is, in the currency bill feeder 5, when the stopper gear 35 is rotated in the direction of arrow R1, the currency bill holder 34 is lifted up via the arm links 33. Because of this, in the currency bill feeder 5, the currency bill holder 34 is separated from the stacked currency bills BLC.

Furthermore, in the currency bill feeder 5, when the stopper gear 35 is rotated in the direction of arrow R2, the load of the currency bill holder 34 is applied to the upper surface of the stacked currency bills BLC to thereby press the stacked currency bills BLC against the floor guide 21.

The floor guide 21 has a flatly formed upper surface and is inclined a predetermined angle of inclination θ from a horizontal plane H in a direction in which its front side is higher. Additionally, the currency bills BL stacked on the upper surface of the floor guide 21 (that is, the stacked currency bills BLC) are placed on the floor guide 21.

On the rear side of the floor guide 21, conveyance guides 22 that guide the currency bills BL when the currency bills BL are conveyed rearward are disposed above and below. Furthermore, picker rollers 23 serving as an example of rollers are disposed under the front side of the floor guide 21.

Figure 4:
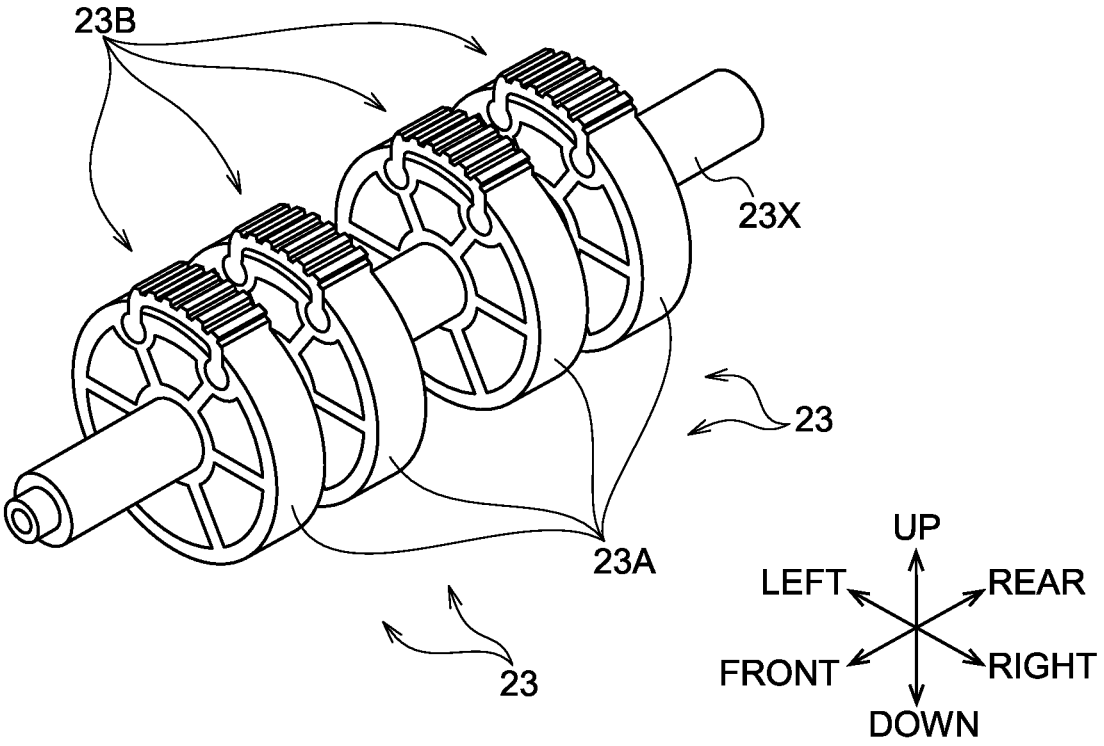
FIG. 4 is a perspective view schematically showing the configuration (1) of picker rollers.

As shown in FIG. 4, the picker rollers 23 are each formed in the shape of a cylinder that is thin in the right and left direction, and a long and narrow cylindrical rotating shaft 23X penetrates the picker rollers 23 in the right and left direction so that the central axes of the picker rollers 23 coincide with one another. Four picker rollers 23 are spaced apart from one another in the right and left direction and attached to the rotating shaft 23X.

Furthermore, the picker rollers 23 each have a roller base portion 23A and a picker portion 23B. The roller base portion 23A is configured by a resin material, for example, and is formed in a shape wherein one section of the peripheral side surface of the thin cylinder is missing. Additionally, the surface of the peripheral side surface of the roller base portion 23A is smoothly finished so as to cause virtually no frictional force to act on the currency bills BL.

Figure 5:
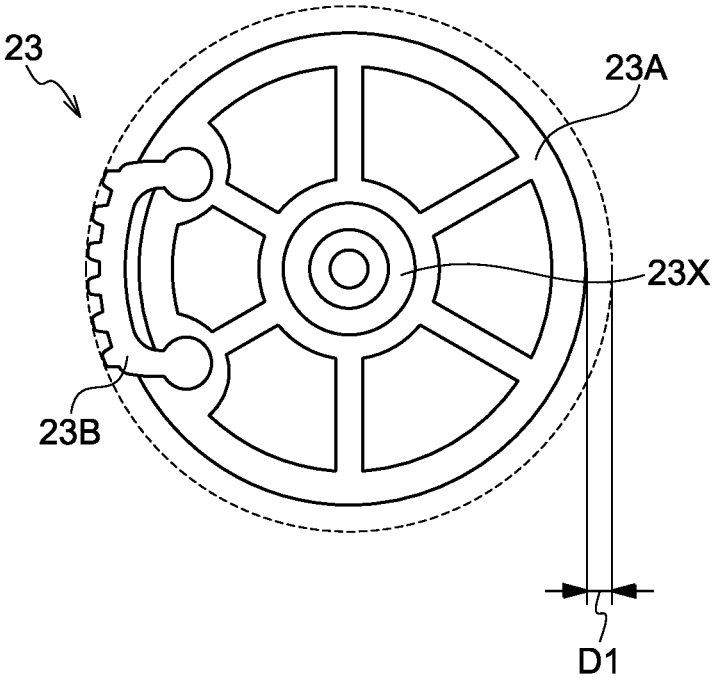
FIG. 5 is a schematic view showing the configuration (2) of the picker rollers.

The picker portion 23B is formed in a shape corresponding to the missing section of the roller base portion 23A. Additionally, as shown in FIG. 5, when the picker portion 23B is fitted into the missing section of the roller base portion 23A, part of the picker portion 23B projects a distance D1 outward from the peripheral side surface of the roller base portion 23A. Outward from the peripheral side surface of the roller base portion 23A is namely the direction away from the roller shaft 23X.

Furthermore, the picker portion 23B is, for example, configured by a material such as rubber that has a high coefficient of friction, so as to cause a high frictional force to act on the currency bills BL.

That is, the picker rollers 23 each have a configuration wherein frictional force is high only in one section of the peripheral side surface while the frictional force of the other section is kept low, and wherein the section whose frictional force is high projects from the other section.

As shown in FIG. 3, the rotating shaft 23X is supported by non-illustrated bearings so that parts of the picker rollers 23 are exposed upward through exposure holes 21H serving as an example of picker holes formed in the floor guide 21. Furthermore, power is transmitted from a non-illustrated motor via a predetermined gear to the rotating shaft 23X.

Here, the positions of the picker rollers 23 are adjusted in such a way that the peripheral side surfaces of the roller base portions 23A are substantially even with the upper surface of the floor guide 21. For this reason, when the picker rollers 23 are rotated together with the rotating shaft 23X so that the picker portions 23B project through the exposure holes 21H, the picker portions 23B project upward the distance D1 (see FIG. 5) from the upper surface of the floor guide 21.

Additionally, when the picker rollers 23 are rotated in the direction of arrow R1 at a constant rotational speed about the rotating shaft 23X, the peripheral side surfaces of the roller base portions 23A and the picker portions 23B are alternately exposed through the exposure holes 21H in the floor guide 21.

When the roller base portions 23A of the picker rollers 23 are exposed through the exposure holes 21H, the roller base portions 23A cause virtually no frictional force to act on the lowermost portion of the stacked currency bills BLC (see FIG. 10) placed on the upper surface of the floor guide 21 and allow the stacked currency bills BLC to slide on them.

When the picker portions 23B of the picker rollers 23 are exposed through the exposure holes 21H, the picker portions 23B project upward from the upper surface of the floor guide 21. Because of this, the picker portions 23B of the picker rollers 23 reliably contact the stacked currency bills BLC, cause frictional force to act on the lowermost portion of the stacked currency bills BLC, and cause a force heading rearward to act on the stacked currency bills BLC.

In this way, the picker portions 23B of the picker rollers 23 are intermittently brought into contact with the lowermost portion of the stacked currency bills BLC placed on the floor guide 21 and cause a force heading rearward to act on the lowermost portion of the stacked currency bills BLC. Because of this, the picker rollers 23 can feed the currency bills BL rearward every predetermined interval of time.

Feed rollers 24 have a configuration partly resembling that of the picker rollers 23, in that the feed rollers 24 are each formed in the shape of a disc that is thin in the right and left direction. Additionally, the peripheral side surface of each of the feed rollers 24 is smoothly formed overall; frictional force is high only in one section, but the section whose frictional force is high does not project upward from the floor guide 21.

Furthermore, the feed rollers 24 are disposed under the conveyance guides 22, with parts of the feed rollers 24 being exposed in the conveyance path, and the feed rollers 24 rotate about a rotating shaft 24X. The rotating shaft 24X is, like the rotating shaft 23X, supported by non-illustrated bearings, and power is transmitted from a non-illustrated motor via a predetermined gear to the rotating shaft 24X.

Gate rollers 25 and conveyance rollers 26 are disposed on the side of the conveyance guides 22 opposite the feed rollers 24—that is, on the upper side of the conveyance guides 22.

The gate rollers 25 are each formed in a cylindrical shape, and the outer peripheral sections of the gate rollers 25 are configured by a member such as rubber that has a high coefficient of friction. Furthermore, the gate rollers 25 rotate about a rotating shaft 25X. However, the rotational direction of the gate rollers 25 is regulated in such a way that the gate rollers 25 freely rotate in the direction of arrow R1, which is the clockwise direction as seen from the right side, but do not rotate in the direction of arrow R2, which is the opposite direction of the direction of arrow R1.

The conveyance rollers 26 are each formed in a cylindrical shape and freely rotate about a non-illustrated rotating shaft.

Furthermore, parts of the gate rollers 25 and the conveyance rollers 26 are exposed in the conveyance path, and the gate rollers 25 and the conveyance rollers 26 are disposed in contact with the feed rollers 24. Additionally, the gate rollers 25 and the conveyance rollers 26 sandwich between themselves and the feed rollers 24 the currency bill BL conveyed in the conveyance guides 22—that is, the gate rollers 25 and the conveyance rollers 26 bring the currency bill BL into contact with the feed rollers 24.

When the feed rollers 24 rotate in the direction of arrow R1 at a constant rotational speed about the rotating shaft 24X, the feed rollers 24 intermittently cause a force heading rearward to act on the currency bill BL to thereby feed the currency bill BL rearward.

At this time, the frictional force of the feed rollers 25 is high and the gate rollers 25 do not rotate in the direction of arrow R2 along the traveling direction of the currency bill BL. Because of this, even if several currency bills BL overlying one another have been fed by the picker rollers 23, the feed rollers 24 can separate and feed just one bill from the lowermost portion of the stacked currency bills BLC.

Furthermore, a currency bill detection sensor 27 and a feed count sensor 28 that detect the presence of the currency bills BL are disposed in the currency bill feeder 5. The currency bill detection sensor 27 and the feed count sensor 28 each emit predetermined detection light from a light emitter, receive the detection light with a light receiver, and detect the presence of the currency bills BL at those places on the basis of the detection light reception result.

The currency bill detection sensor 27 is disposed in such a way that the detection light crosses the upper surface of the floor guide 21, and the currency bill detection sensor 27 sends the detection light reception result to the control unit 3 (see FIG. 1). The control unit 3 discriminates, on the basis of this reception result, whether there is one or more currency bills BL on the floor guide 21 or whether there are no currency bills BL at all on the floor guide 21.

The feed count sensor 28 is disposed in such a way as to cross the conveyance path in the conveyance guides 22, and the feed count sensor 28 sends the detection light reception result to the control unit 3. The control unit 3 discriminates whether or not the currency bills BL have been separated one at a time and normally conveyed by comparing the amount of time in which the detection light was blocked by each currency bill BL with a standard amount of time in which the detection light is blocked when one currency bill BL is normally conveyed.

Here, if the amount of time in which the detection light was blocked is in a normal range, the control unit 3 discriminates that the currency bills BL have been separated one at a time and normally conveyed and allows the feeding of the currency bills BL in the currency bill feeder 5 to continue.

In a case where the amount of time in which the detection light was blocked is outside the normal range—that is, too long or too short—or the detection light was not blocked at all, the control unit 3 discriminates that an abnormality such as overlapped feeding or jamming of the currency bills BL or damage has occurred. Additionally, the control unit 3 suspends the feeding of the currency bills BL and displays a predetermined message or the like on the display and operation unit 4.

In this way, in the currency bill feeder 5, the picker rollers 23 and the feed rollers 24 are rotated as the stacked currency bills are pressed against the floor guide 21 by the currency bill holder 34. Because of this, the currency bill feeder 5 separates and feeds the currency bills BL one at a time and delivers the currency bills BL to the conveyor 7 (see FIG. 2).

[1-3. Configuration of Currency Bill Holder]

As shown in FIG. 3, the currency bill holder 34 is configured by an upper pressing plate 41 serving as an example of a pressing member, slide guides 42, a lower pressing plate 43 serving as an example of an auxiliary pressing member, and springs 44 serving as an example of absorbing members.

Figure 6:
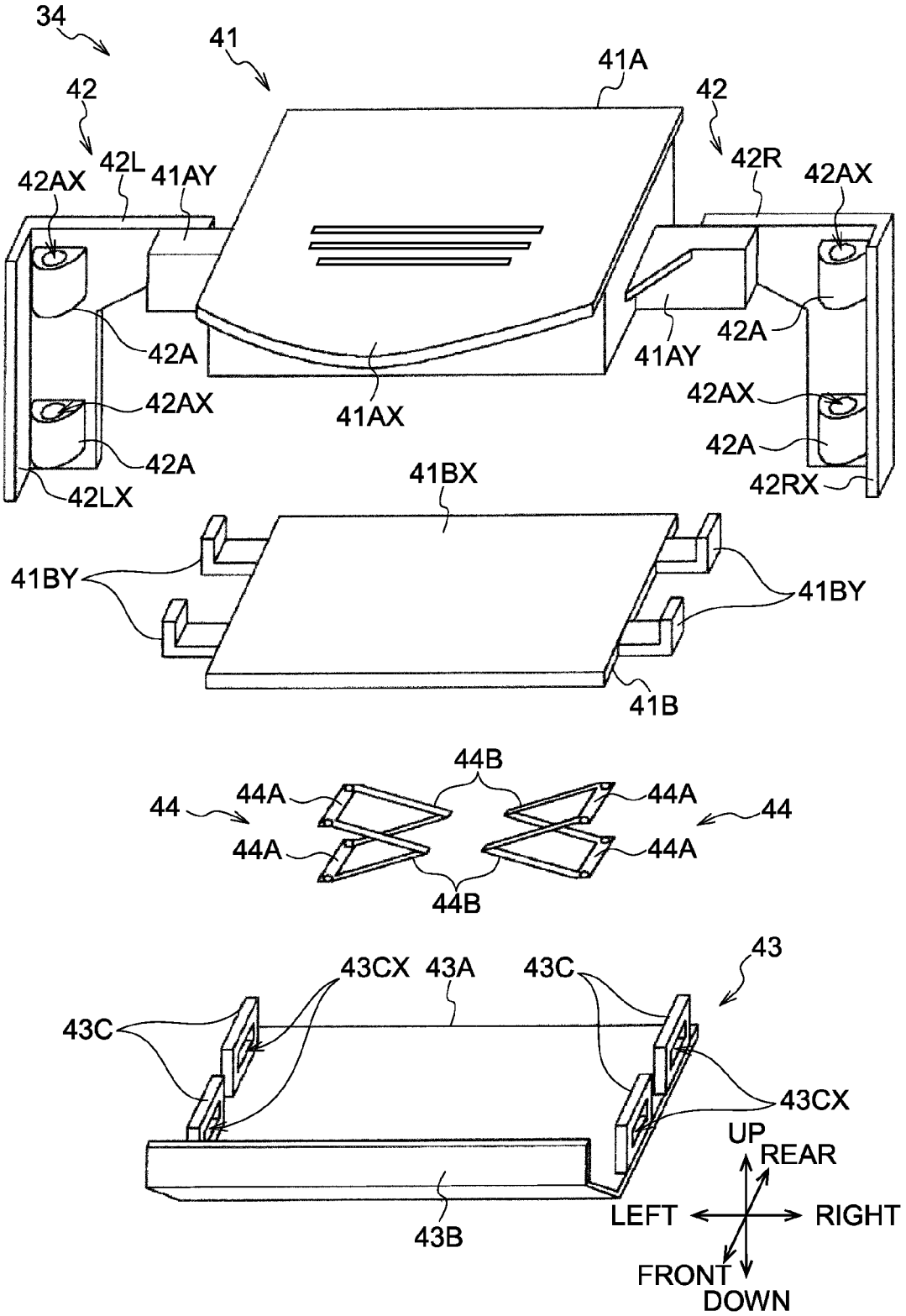
FIG. 6 is a perspective view schematically showing the configuration of a currency bill holder according to a first embodiment.

As shown in FIG. 6, the upper pressing plate 41 has a configuration where a lower side member 41B is attached to and integrated with the lower surface of an upper side member 41A.

The upper side member 41A is configured in the shape of a cuboid that is long in the right and left direction, short in the front and rear direction, and thin in the up and down direction, and the upper surface of the upper side member 41A extends frontward in the shape of a semi-disc to thereby form a grip portion 41AX. Furthermore, small cuboid-shaped attachment portions 41AY are disposed projecting from the right and left sides of the upper side member 41A.

The lower side member 41B is configured around a base plate 41BX comprising a thin plate that is long in the right and left direction and short in the front and rear direction, and claw-like portions 41BY serving as an example of regulating bodies are disposed on the right and left side edges of the lower side member 41B in places near the front and near the rear. The claw-like portions 41BY extend outward in the right and left directions from the lower side member 41B and then extend upward, so that the claw-like portions 41BY are each formed in the shape of an L as seen from the front and rear direction.

The slide guides 42 are attached to the rear surfaces of the right and left attachment portions 41AY of the upper pressing plate 41. The slide guides 42 are configured to be symmetrical to one another in the right and left direction, so in the description below, the slide guide 42 on the left side will be taken as an example and described.

The slide guide 42 on the left side is configured around a base plate 42L. The base plate 42L comprises a thin plate having a vertically inverted L shape as seen from the front, and a reinforcement plate 42LX that extends frontward is disposed on the left side edge of the base plate 42L.

The slide guide 42 on the right side is configured around a base plate 42R that is symmetrical to the base plate 42L in the right and left direction, and a reinforcement plate 42RX that extends frontward is disposed on the right side edge of the base plate 42R.

Two bearing portions 42A are arranged adjacent to one another in the up and down direction and attached to the left side of the front surface of the base plate 42L. Insertion holes 42AX are formed in the bearing portions 42A. The insertion holes 42AX have an inner diameter that is slightly larger than the outer diameter of the slide shafts 32 (see FIG. 3), and the insertion holes 42AX penetrate the bearing portions 42A in the up and down direction. Additionally, the inside surfaces of the insertion holes 42AX are smoothly formed so that sliding friction is kept low.

Because of this, when the right and left slide shafts 32 (see FIG. 3) are inserted into the bearing portions 42A of the right and left slide guides 42, the upper side member 41A can freely move up and down along the slide shafts 32.

Here, the position of the upper side member 41A in the front and rear direction and the right and left direction is defined by the bearing portions 42A spaced apart from one another in the up and down direction on the right and left sides with respect to the right and left slide shafts 32. For this reason, the movement of the upper side member 41A in the front and rear direction and the right and left direction and the rotation of the upper side member 41A in rotational directions about axes along the up and down direction, the right and left direction, and the front and rear direction (hereinafter called the roll direction, the pitch direction, and the yaw direction, respectively) both become regulated.

The lower pressing plate 43 is configured around a base plate 43A comprising a thin plate that is long in the right and left direction and short in the front and rear direction. The length of the base plate 43A in the right and left direction is sufficiently longer than the length of the long-dimension edges of the currency bills BL, and the length of the base plate 43A in the front and rear direction is sufficiently longer than the length of the short-dimension edges of the currency bills BL. Additionally, the mass of the base plate 43A is sufficiently smaller than that of the upper side member 41A.

Furthermore, a front surface plate 43B is formed in the lower pressing plate 43 as a result of the front side section of the base plate 43A being bent diagonally frontward and upward and then that front side section being bent upward.

Moreover, frame-like portions 43C serving as an example of regulated bodies that extend upward are disposed on the lower pressing plate 43 in places near the front and near the rear of the right and left side edges. The frame-like portions 43C each comprise a small plate that is thin in the right and left direction, and a rectangular hole-like hole portion 43CX that penetrates the plate in the right and left direction is formed in the center of each of the frame-like portion 43C.

The front and rear direction length of the hole portions 43CX is longer than the front and rear direction length of the claw-like portions 41BY of the upper pressing plate 41. Furthermore, the up and down direction length of the hole portions 43CX is greater than the projecting distance D1 (see FIG. 5) of the picker portions 23B of the picker rollers 23.

Moreover, the springs 44 are attached in such a way that one spring each is interposed on the right and left sides between the upper pressing plate 41 and the lower pressing plate 43. The two springs 44 are configured to be symmetrical to one another in the right and left direction, so in the description below, the spring 44 on the left side will be taken as an example and described.

The spring 44 on the left side comprises a so-called plate spring and has two attachment portions 44A and two plate spring portions 44B. The two attachment portions 44A are long and narrow plates along the front and rear direction and are disposed adjacent to one another in the up and down direction. Furthermore, the two plate spring portions 44B have configurations wherein plate-like members that extend diagonally downward and rightward and diagonally upward and rightward from the front and rear end portions of the right edges of the attachment portions 44A are connected to one another in the vicinity of their centers in the up and down direction, and the plate spring portions 44B are disposed adjacent to one another in the front and rear direction.

In other words, the spring 44 on the left side has a configuration where a pair of opposing sides of a plate-like member comprising a rectangular frame are bent in the neighborhoods of their center points to an extent that they form acute angles, and those bent sections point rightward.

The upper and lower attachment portions 44A are secured to the lower surface of the upper pressing plate 41 and the upper surface of the lower pressing plate 43 by non-illustrated attachment screws or the like.

Because of this, the spring 44 on the left side can, because of the plate spring portions 44B, cause elastic force to act in the up and down direction between the upper pressing plate 41 and the lower pressing plate 43—that is, the spring 44 can function as an elastic body.

The compressible length of the springs 44 from their natural state to their most compressed state (a state in which the upper and lower attachment portions 44A contact one another) is greater than the projecting distance D1 (see FIG. 5) of the picker portions 23B of the picker rollers 23. Furthermore, the springs 44 have a spring constant that is appropriately selected so that the response speed of the springs 44 is sufficiently fast (this will be described in detail below).

Figure 7A:
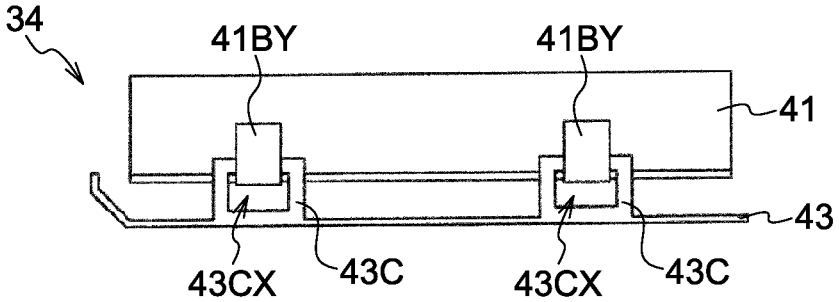
FIG. 7A is a schematic view showing the movement (1)-A of a lower pressing plate in the currency bill holder according to the first embodiment.
Figure 8A:
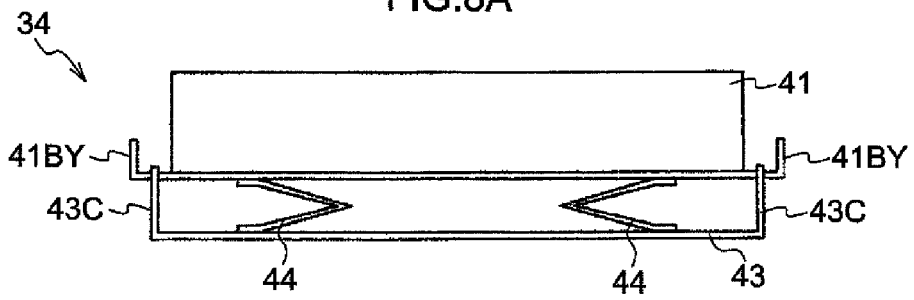
FIG. 8A is a schematic view showing the movement (2)-A of the lower pressing plate in the currency bill holder according to the first embodiment.

As shown in FIG. 7A and FIG. 8A, the currency bill holder 34 is assembled by interposing the springs 44 on the right and left sides between the upper pressing plate 41 and the lower pressing plate 43 and inserting the claw-like portions 41BY of the upper pressing plate 41 through the four hole portions 43CX in the lower pressing plate 43.

Because of this, in the currency bill holder 34, the lower pressing plate 43 can be positioned roughly directly under the upper pressing plate 41 and the lower pressing plate 43 can be moved or rotated in the range in which the positions and angles of the frame-like portions 43C are regulated by the claw-like portions 41BY.

Here, the springs 44 are compressed a certain extent in the up and down direction from their natural state even in a state in which the lower pressing plate 43 is farthest away from the upper pressing plate 41—that is, a state in which the springs 44 are most extended in the up and down direction (see FIG. 7A and FIG. 8A).

For this reason, in the currency bill holder 34, if no upward external force is being applied to the lower pressing plate 43, as shown in FIG. 7A and FIG. 8A, the claw-like portions 41BY are brought into contact with the lower edges of the frame-like portions 43C. Because of this, in the currency bill holder 34, the lower pressing plate 43 is most separated from the upper pressing plate 41.

On the other hand, in the currency bill holder 34, when an upward external force is applied to the lower pressing plate 43, the lower pressing plate 43 is moved closer to the upper pressing plate 41 while the springs 44 are compressed in the range in which the claw-like portions 41BY are positioned in the hole portions 43CX of the frame-like portions 43C.

Figure 7B:
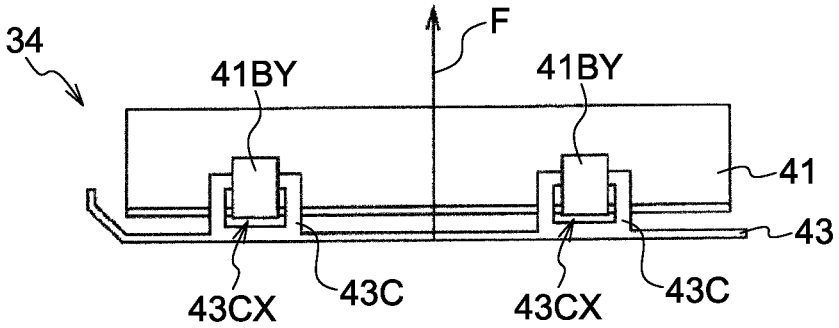
FIG. 7B is a schematic view showing the movement (1)-B of the lower pressing plate in the currency bill holder according to the first embodiment.
Figure 8B:
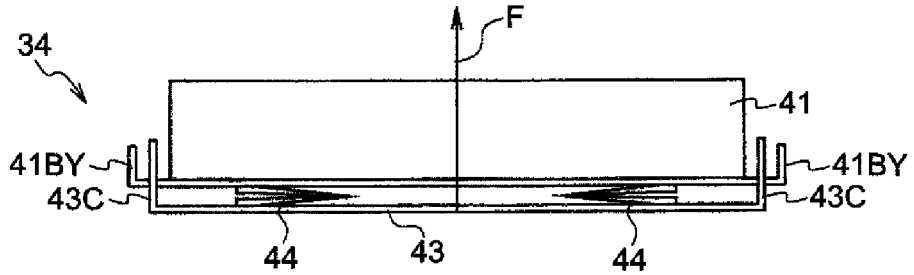
FIG. 8B is a schematic view showing the movement (2)-B of the lower pressing plate in the currency bill holder according to the first embodiment.

Here, in the currency bill holder 34, as shown in FIG. 7B and FIG. 8B, if the direction of an external force F applied to the lower pressing plate 43 is directly up, the base plate 43A of the lower pressing plate 43 (see FIG. 6) is pushed up in a parallel manner.

Figure 7C:
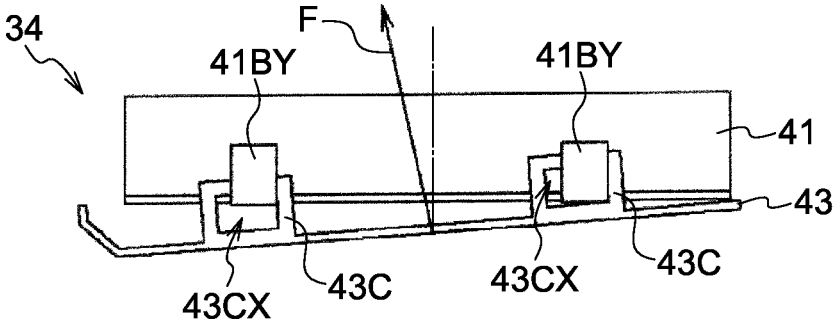
FIG. 7C is a schematic view showing the movement (1)-C of the lower pressing plate in the currency bill holder according to the first embodiment.
Figure 7D:
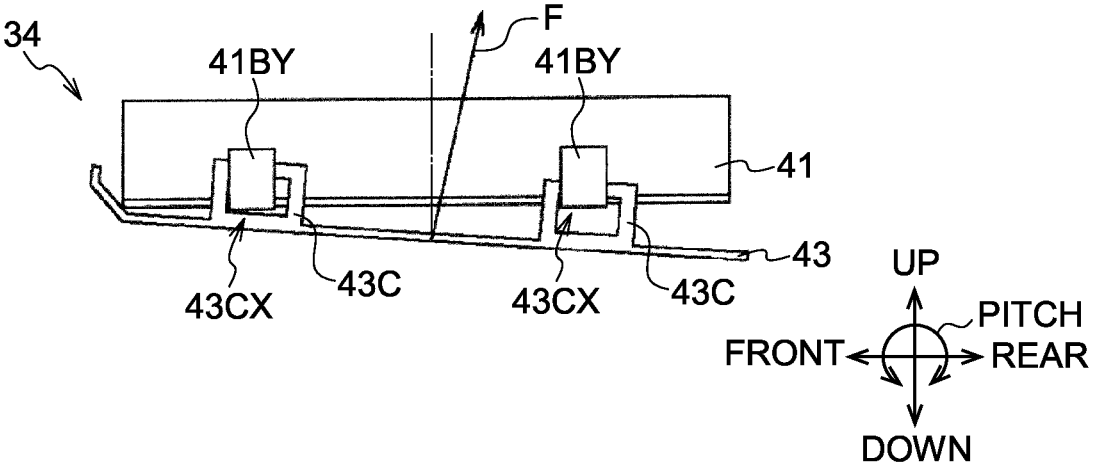
FIG. 7D is a schematic view showing the movement (1)-D of the lower pressing plate in the currency bill holder according to the first embodiment.

Furthermore, in the currency bill holder 34, if the direction of the external force F applied to the lower pressing plate 43 is inclined frontward, as shown in FIG. 7C, this causes the lower pressing plate 43 to be inclined in such a way that the rear side of the lower pressing plate 43 is pushed up higher than the front side and the lower surface of the lower pressing plate 43, which serves as an example of an opposing surface, faces downward and rearward. Or, in the currency bill holder 34, if the direction of the external force F applied to the lower pressing plate 43 is inclined rearward, as shown in FIG. 7D, this causes the lower pressing plate 43 to be inclined in such a way that the front side of the lower pressing plate 43 is pushed up higher than the rear side and the lower surface of the lower pressing plate 43 faces downward and frontward.

Figure 8C:
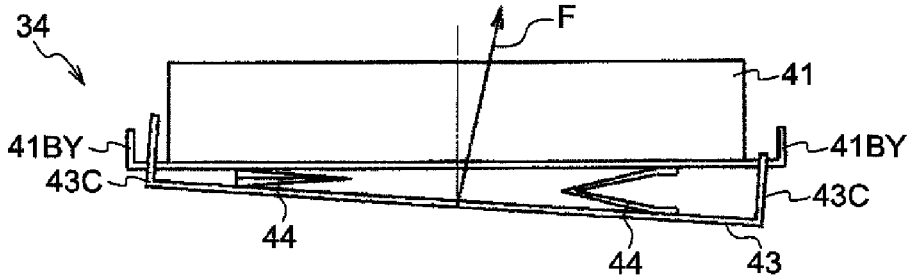
FIG. 8C is a schematic view showing the movement (2)-C of the lower pressing plate in the currency bill holder according to the first embodiment.
Figure 8D:
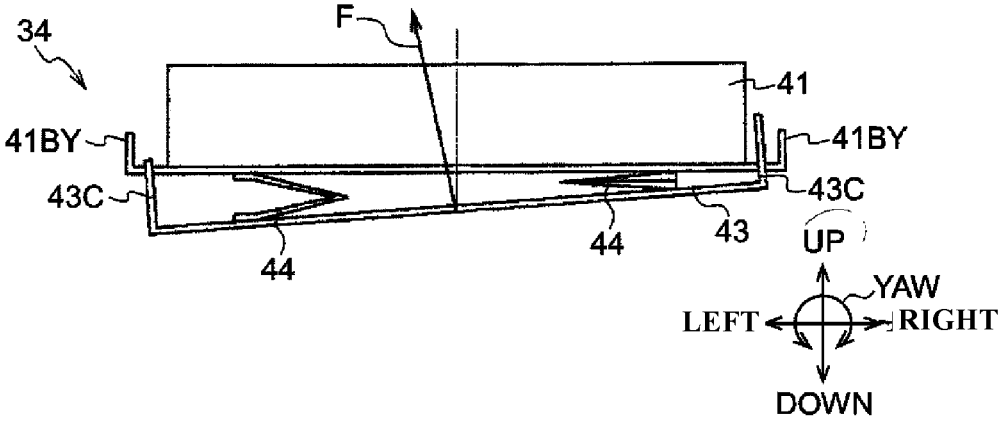
FIG. 8D is a schematic view showing the movement (2)-D of the lower pressing plate in the currency bill holder according to the first embodiment.

Moreover, in the currency bill holder 34, if the direction of the external force F applied to the lower pressing plate 43 is inclined rightward, as shown in FIG. 8C, this causes the lower pressing plate 43 to be inclined in such a way that the left side of the lower pressing plate 43 is pushed up higher than the right side and the lower surface of the lower pressing plate 43 faces downward and leftward. Or, in the currency bill holder 34, if the direction of the external force F applied to the lower pressing plate 43 is inclined leftward, as shown in FIG. 8D, this causes the lower pressing plate 43 to be inclined in such a way that the right side of the lower pressing plate 43 is pushed up higher than the left side and the lower surface of the lower pressing plate 43 faces downward and rightward.

That is, in the currency bill holder 34, the lower pressing plate 43 is not just moved in the up and down direction relative to the upper pressing plate 41 (see FIG. 7B and FIG. 8B). In the currency bill holder 34, the lower pressing plate 43 is also rotated in the pitch direction about an axis running along the right and left direction (see FIG. 7C and FIG. 7D). Or, in the currency bill holder 34, the lower pressing plate 43 is also rotated in the yaw direction about an axis running along the front and rear direction (see FIG. 8C and FIG. 8D).

As shown in FIG. 6, the fold lines of the bent sections of the plate spring portions 44B disposed on the front and rear sides of the springs 44 are along the front and rear direction.

For this reason, because of the torsional stiffness of the plate spring portions 44B of the springs 44, the attachment portions 44A on the lower side are virtually not moved in the front and rear direction relative to the attachment portions 44A on the upper side. That is, in the currency bill holder 34, the lower pressing plate 43 is virtually not moved in the front and rear direction relative to the upper pressing plate 41.

Furthermore, in the currency bill holder 34, because of the engagement between the frame-like portions 43C and the claw-like portions 41BY, the amount of movement of the lower pressing plate 43 in the right and left direction relative to the upper pressing plate 41 is also kept extremely small.

In this way, in the currency bill holder 34, the lower pressing plate 43 is disposed under the upper pressing plate 41 with the springs 44 being interposed between them. Because of this, in the currency bill holder 34, elastic force acts on the lower pressing plate 43 from the upper pressing plate 41, and the lower pressing plate 43 is moved in the up and down direction or is rotated in the pitch direction or the yaw direction.

[1.4 Comparison of Feeding Actions]

Next, the action of the feeding of the currency bills in the currency bill feeder 5 will be described by way of a comparison with a conventional currency bill feeder.

[1-4-1. Feeding Action Resulting from Conventional Currency Bill Feeder]

Figure 9:
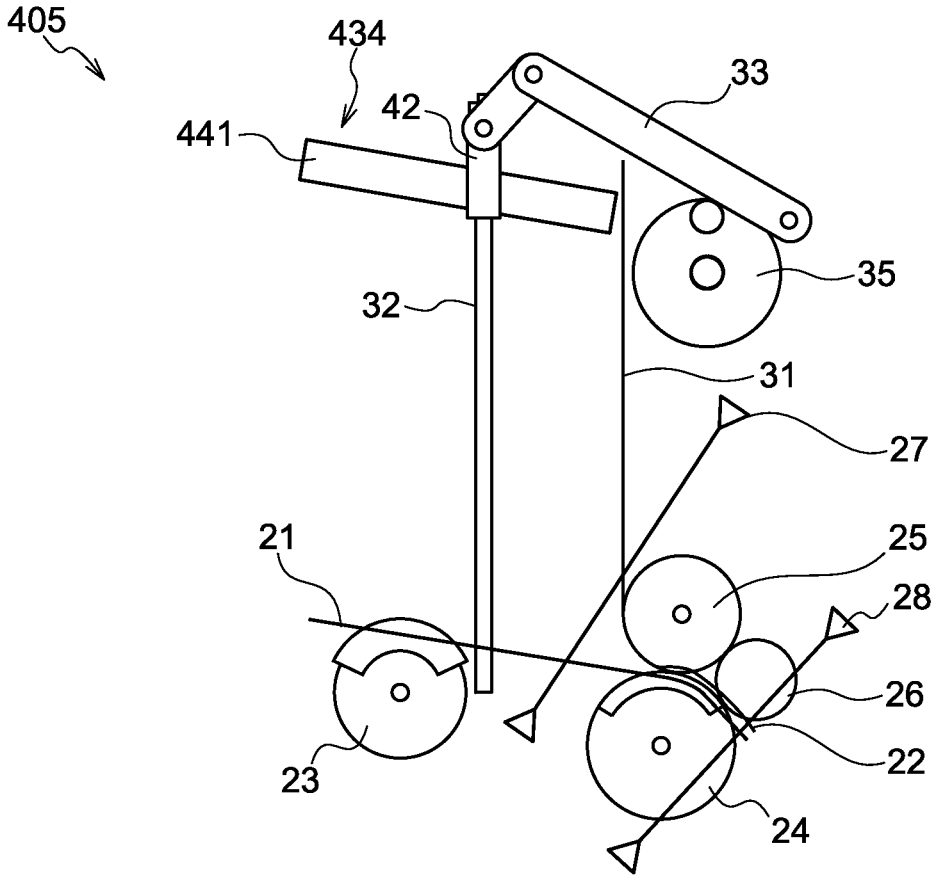
FIG. 9 is a schematic view showing the configuration of a conventional currency bill feeder.

As shown in FIG. 9, which corresponds to FIG. 3, a conventional currency bill feeder 405 differs from the currency bill feeder 5 in the first embodiment of the present invention in that it has a currency bill holder 434 instead of the currency bill holder 34, but other sections of the currency bill feeder 405 are configured in the same way as those of the currency bill feeder 5.

The currency bill holder 434 is configured by a pressing plate 441, which is configured in substantially the same way as the upper pressing plate 41, and slide guides 42, and the currency bill holder 434 does not have the lower pressing plate 43 and the springs 44 (see FIG. 3).

In the currency bill feeder 405, when the currency bill holder 434 is lifted up beforehand via the arm links 33 by the predetermined stopper gear 35, a stacking space is formed between the floor guide 21 and the pressing plate 441.

Figure 10:
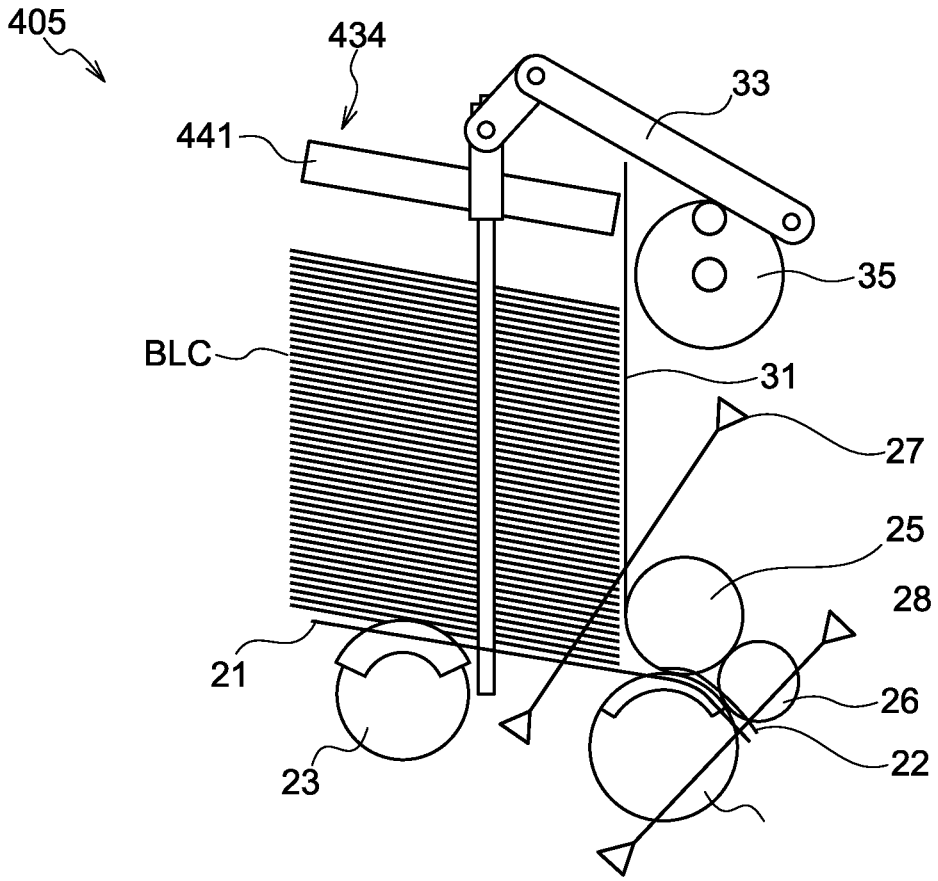
FIG. 10 is a schematic view showing the loading of currency bills in the conventional currency bill feeder.

Then, in the currency bill feeder 405, as shown in FIG. 10, currency bills BL in a stacked state are placed by the hand of the operator (not illustrated) on the upper surface of the floor guide 21. Thereafter, the operator operates the operation button 6 (see FIG. 1).

Figure 11:
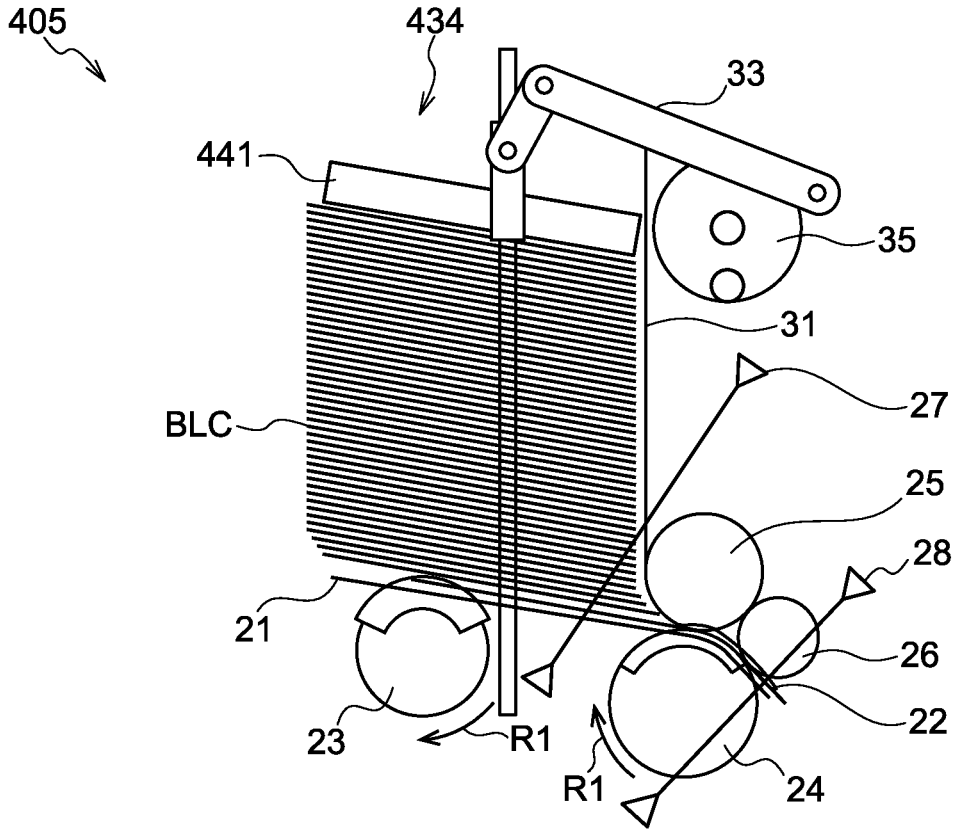
FIG. 11 is a schematic view showing the feeding of currency bills in the conventional currency bill feeder.

In response to this operation, in the currency bill feeder 405, as shown in FIG. 11, the stopper gear 35 is rotated to thereby release the support of the arm links 33 and the currency bill holder 434. Then, in the currency bill feeder 405, the currency bill holder 434 is placed on the stacked currency bills BL (hereinafter these will be called stacked currency bills BLC).

Because of this, the weight of the currency bill holder 434 is applied to the uppermost portion of the stacked currency bills BLC, so the lowermost portion of the stacked currency bills BLC is pressed against the floor guide 21 and the picker rollers 23.

Moreover, in the currency bill feeder 405, the picker rollers 23 and the feed rollers 24 are rotated in the direction of arrow R1. Because of this, in the currency bill feeder 405, the currency bills BL in the lowermost portion of the stacked currency bills BLC are separated one at a time and sequentially fed rearward into the currency bill processing device.

Figure 12:
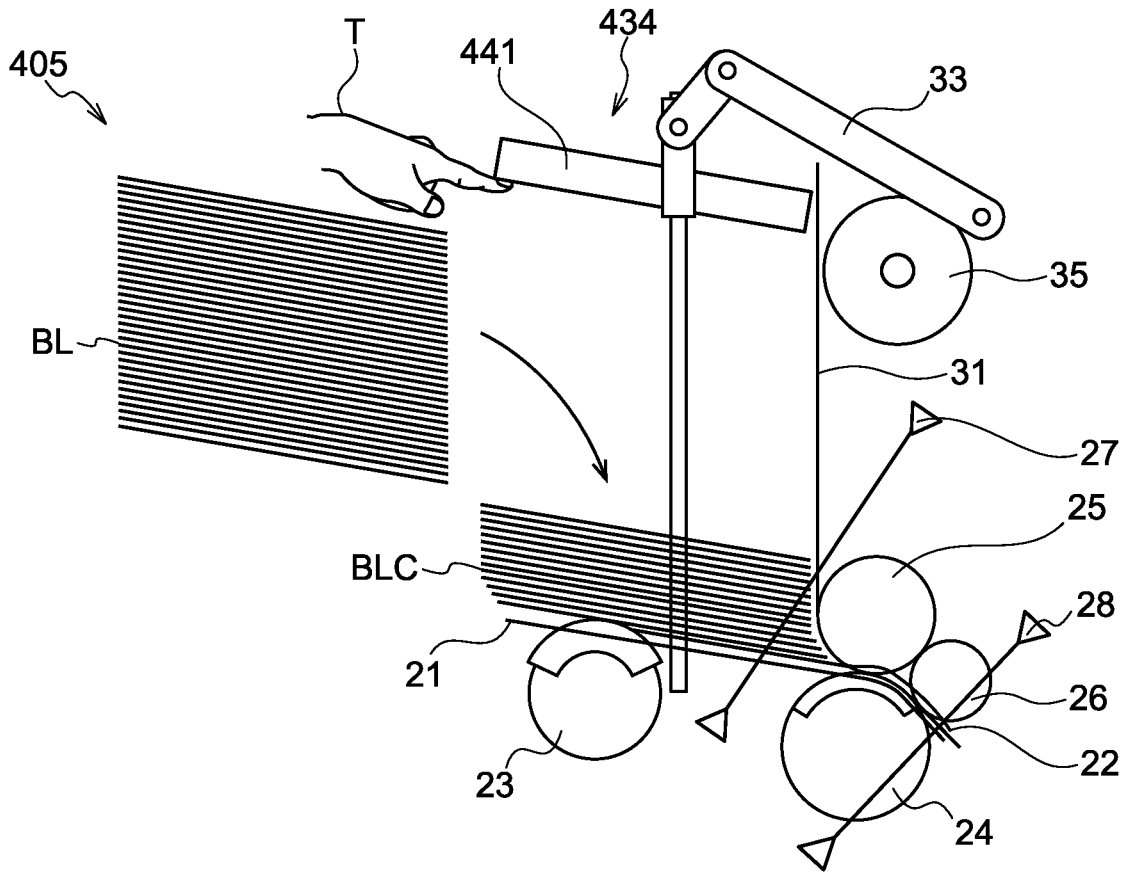
FIG. 12 is a schematic view showing the adding of currency bills in the conventional currency bill feeder.

Furthermore, in the currency bill feeder 405, when new currency bills BL are to be added while the feeding of the currency bills BL continues, as shown in FIG. 12, the pressing plate 441 is lifted up by a hand T of the operator and the new currency bills BL are stacked on top of the existing stacked currency bills BLC.

Because of this, in the currency bill feeder 405, the new currency bills BL can be sequentially added without having to suspend the feeding of the currency bills BL, so the currency bill feeder 405 can efficiently feed the currency bills BL.

In this connection, as described above, the picker portions 23B of the picker rollers 23 of the currency bill feeder 405 project outward from the roller base portions 23A (see FIG. 4 and FIG. 5).

For this reason, in the currency bill feeder 405, the picker portions 23B of the picker rollers 23 apply an external force upward to the lower surface of the stacked currency bills BLC in accompaniment with the rotation of the picker rollers 23. Additionally, in the currency bill feeder 405, the stacked currency bills BLC are moved in a short amount of time upward along the mask guide 31, so that the stacked currency bills BLC are periodically kicked upward.

As a result, the stacked currency bills BLC vibrate in the up and down direction, with the amplitude of the vibration being the distance D1 (see FIG. 5) that is the amount that the picker portions 23B of the picker rollers 23 project from the roller base portions 23A.

At this time, if the number of the stacked currency bills BLC is relatively large (e.g., two hundred bills or more), the stacked currency bills BLC themselves function as a vibration absorbing member. For this reason, the vibration of the stacked currency bills BLC is virtually not transmitted to the pressing plate 441.

Figure 13:
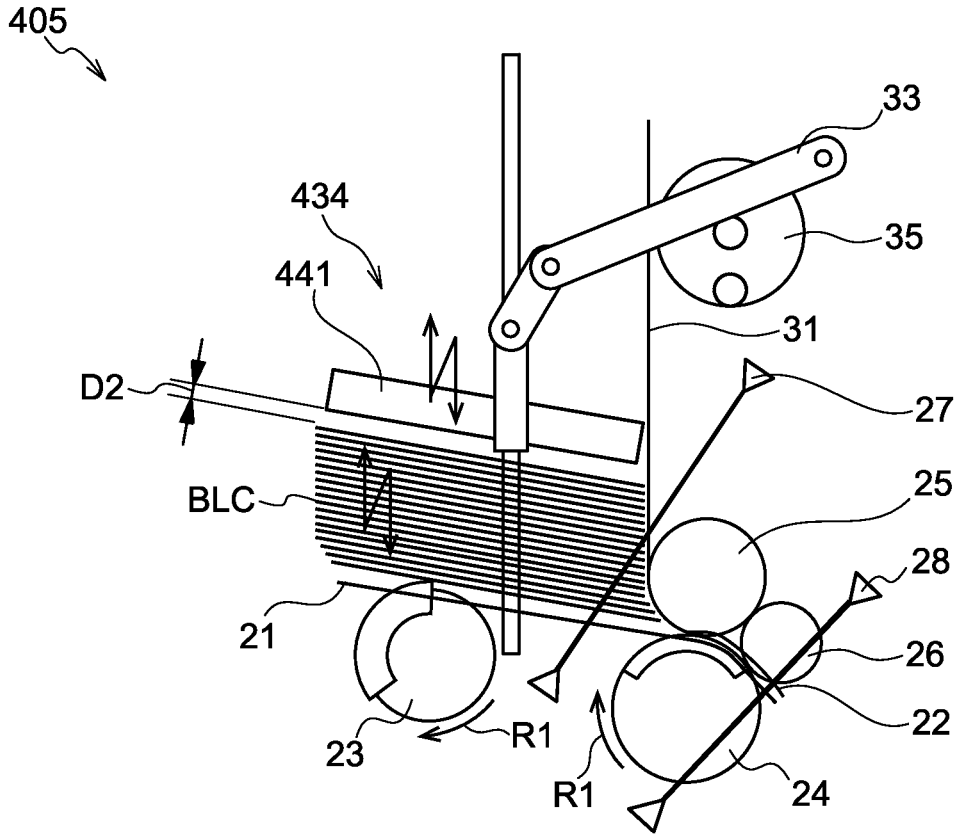
FIG. 13 is a schematic view showing the formation of a gap in the conventional currency bill feeder.

However, if the number of the stacked currency bills BLC is relatively small (e.g., around one hundred bills), the function of the stacked currency bills BLC as a vibration absorbing member is weakened. Additionally, as shown in FIG. 13, the vibration of the stacked currency bills BLC becomes transmitted to the pressing plate 441.

Here, in the currency bill feeder 405, because of the differences in the masses and moments of inertia and the like between the stacked currency bills BLC and the pressing plate 441, the potential for the phases of the vibration of the stacked currency bills BLC and the vibration of the pressing plate 441 to differ is high. At this time, a gap D2 ends up being formed between the stacked currency bills BLC and the pressing plate 441.

Figure 14:
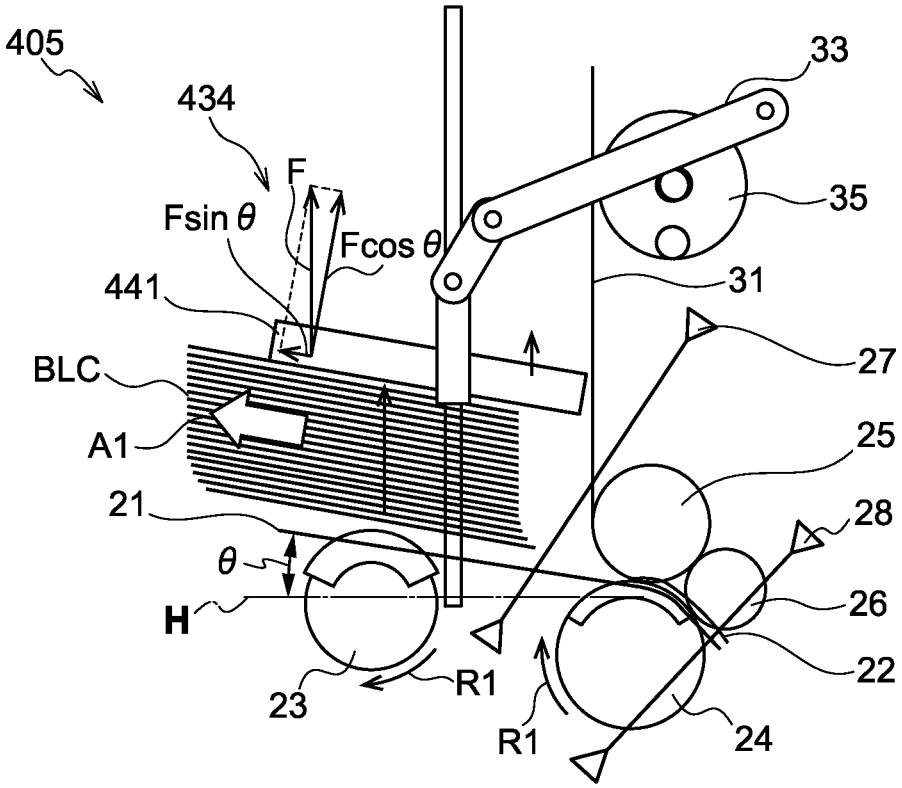
FIG. 14 is a schematic view showing the movement (1) of currency bills in the conventional currency bill feeder.

When the stacked currency bills BLC are kicked upward by the picker portions 23B while the gap D2 is formed, the upper surface of the stacked currency bills BLC comes into contact with the lower surface of the pressing plate 441 because the speed at which the stacked currency bills BLC ascend is faster than the speed at which the pressing plate 441 ascends. Additionally, as shown in FIG. 14, the stacked currency bills BLC cause a force F to act in the vertical direction on the pressing plate 441.

Here, in the currency bill feeder 405, the floor guide 21 is inclined by the angle of inclination θ relative to the horizontal plane H in such a way that its front side is higher. For this reason, in the currency bill feeder 405, the upper surfaces and the lower surfaces of both the pressing plate 441 and the stacked currency bills BLC placed on the floor guide 21 are inclined substantially by the angle of inclination θ.

That is, although the pressing plate 441 can stop force F cos θ, which is the directional component of the force F orthogonal to the lower surface of the pressing plate 441, it cannot stop force F sin θ, which is the directional component of the force F parallel to the lower surface of the pressing plate 441.

For this reason, because of the action of the force F sin θ, the stacked currency bills BLC stick out slightly frontward and upward as indicated by arrow A1.

Figure 15:
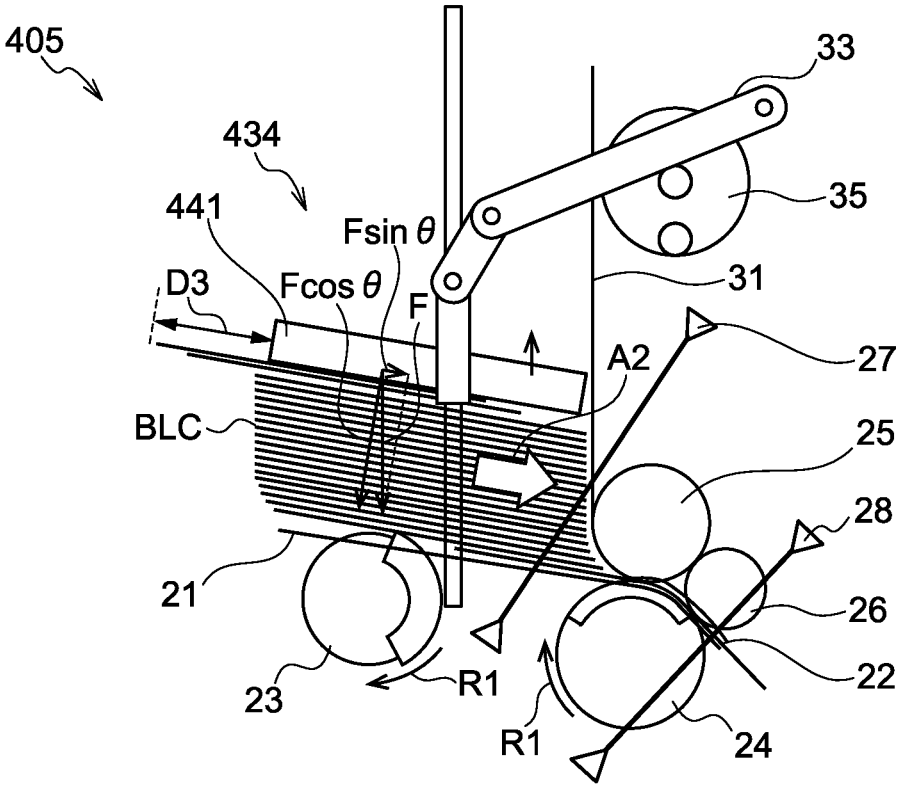
FIG. 15 is a schematic view showing the movement (2) of currency bills in the conventional currency bill feeder.

After the stacked currency bills BLC stick out slightly frontward and upward, the force of gravity changes the direction of motion of the pressing plate 441 from ascending to descending. Then, as shown in FIG. 15, the pressing plate 441 applies a force F heading downward to the uppermost portion of the stacked currency bills BLC from the lower surface of the pressing plate 441.

At this time, the stacked currency bills BLC try to move rearward and downward until they contact the mask guide 31 because F sin θ, which is the directional component parallel to the lower surface of the pressing plate 441, acts in the rearward and downward direction.

However, the stacked currency bills BLC receive the F cos θ force from the pressing plate 441, so the potential for the frictional force acting between the currency bills BL to differ is higher compared to when the upward force acted. At this time, all or some of the stacked currency bills BLC, and particularly the currency bills BL in the uppermost portion, end up remaining in the state in which they stick out frontward.

Figure 16:
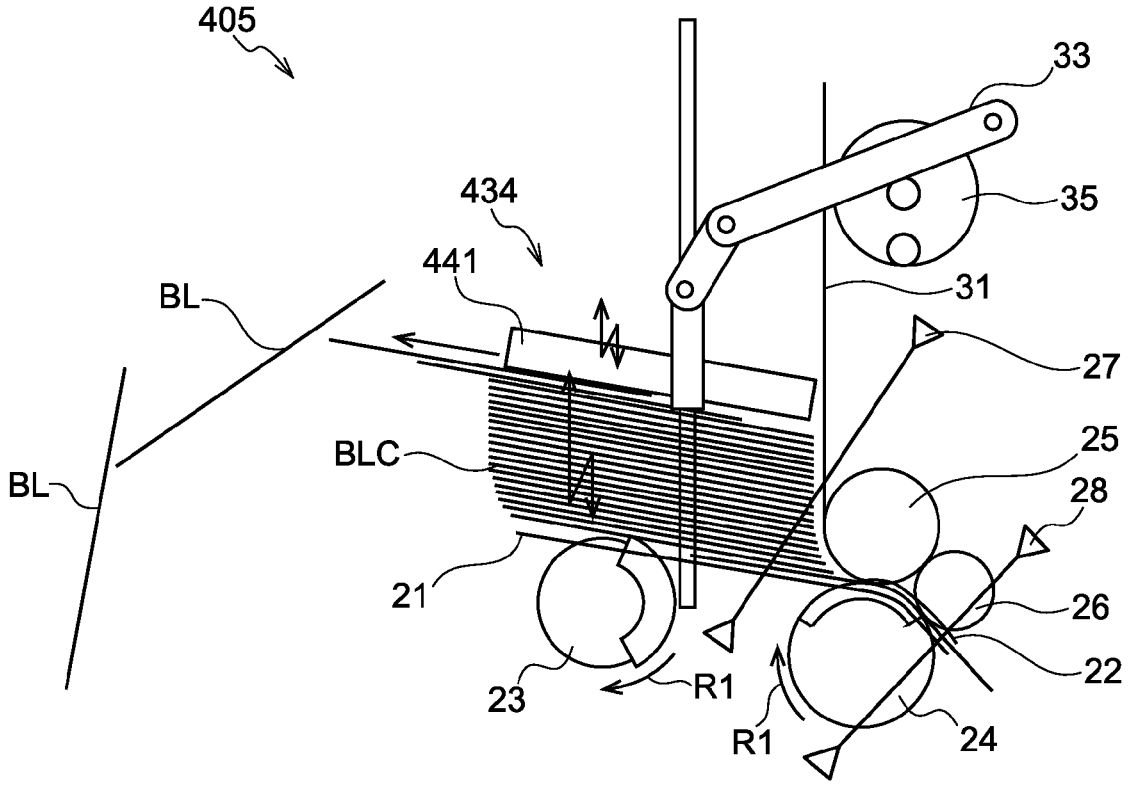
FIG. 16 is a schematic view showing the occurrence of a currency bill collapse in the conventional currency bill feeder.

Thereafter, in the currency bill feeder 405, as shown in FIG. 16, the amount D3 that the stacked currency bills BLC stick out (see FIG. 15) ends up gradually increasing as a result of the series of actions being repeated. Then, in the currency bill feeder 405, eventually when the currency bills BL in the upper portion of the stacked currency bills BLC stick out frontward even more than the front end of the pressing plate 441 and collapse, this ends up triggering a so-called "currency bill collapse".

In this way, in the conventional currency bill feeder 405, there have been times when a "currency bill collapse" is triggered as a result of the pressing plate 441 being temporarily separated from the stacked currency bills BLC vibrating up and down and this being repeated.

[1-4-2. Feeding Action Resulting from Currency Bill Feeder of First Embodiment]

In the currency bill feeder 5 of the first embodiment, as described above, the springs 44 are interposed between the upper pressing plate 34 and the lower pressing plate 43 in the currency bill holder 34.

Figure 17:
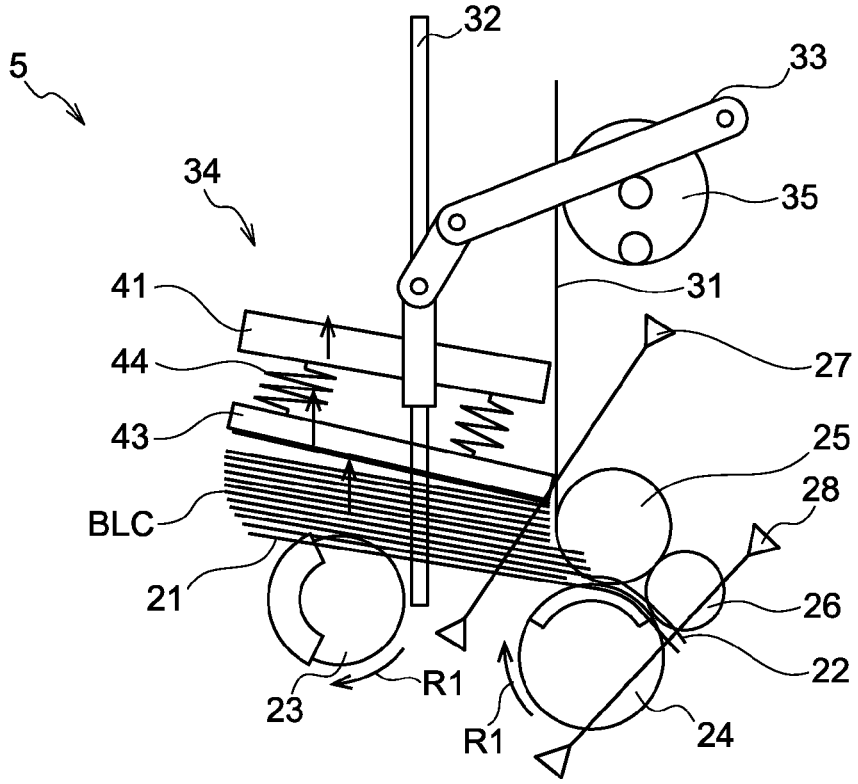
FIG. 17 is a schematic view showing the movement (1) of currency bills in the currency bill feeder of the present invention.

For this reason, in the currency bill feeder 5, as shown in FIG. 17, which corresponds to FIG. 13, when the picker rollers 23 are rotated in a state in which the number of the stacked currency bills BLC is relatively small, the picker portions 23B periodically kick the stacked currency bills BLC upward like in the conventional currency bill feeder 405. Additionally, the function of the stacked currency bills BLC as a vibration absorbing member is weak, so a force heading upward becomes applied to the lower pressing plate 43.

Here, in the currency bill holder 34 of the currency bill feeder 5, as described above, the mass of the lower pressing plate 43 is smaller compared to the combined mass of the upper pressing plate 41 and the slide guides 42. Furthermore, in the currency bill holder 34, the spring constant of the springs 44 is appropriately selected.

For this reason, in the currency bill holder 34, the lower pressing plate 43 is moved upward substantially integrally with the stacked currency bills BLC, but because the springs 44 are compressed in the up and down direction, the upward force is absorbed and the upper pressing plate 41 is virtually not moved.

That is, in the currency bill holder 34, only the lower pressing plate 43 is moved upward together with the stacked currency bills BLC when the stacked currency bills BLC are kicked upward. In the currency bill holder 34, the upper pressing plate 41 substantially remains in its position as is.

At this time, in the currency bill holder 34, the up and down direction length of the hole portions 43CX (see FIG. 6) is greater than the projecting distance D1 (see FIG. 5) of the picker portions 23B of the picker rollers 23. For this reason, in the currency bill holder 34, the claw-like portions 41BY (see FIG. 6) are not brought into contact with the upper edges of the frame-like portions 43C (see FIG. 6). Furthermore, in the currency bill holder 34, because the compressible length of the springs 44 is longer than the projecting distance D1, the springs 44 do not become completely compressed, so the upward force can be absorbed without causing a so-called "bottoming out".

Thereafter, in the currency bill feeder 5, the rotation of the picker rollers 23 is continued and the picker portions 23B become positioned under the floor guide 21. Because of this, the stacked currency bills BLC fall because of the force of gravity.

At this time, in the currency bill holder 34, the force heading upward from the stacked currency bills BLC no longer acts, so the upper pressing plate 41, the slide guides 42, and the lower pressing plate 43 all try to fall because of the force of gravity.

Here, in the currency bill holder 34, the mass of the lower pressing plate 43 is smaller than the combined mass of the upper pressing plate 41 and the slide guides 42. Furthermore, in the currency bill holder 34, the compressed springs 44 cause a force to act in the up and down direction because of their restoring force, and the response speed of the springs 44 is sufficiently fast.

Figure 18:
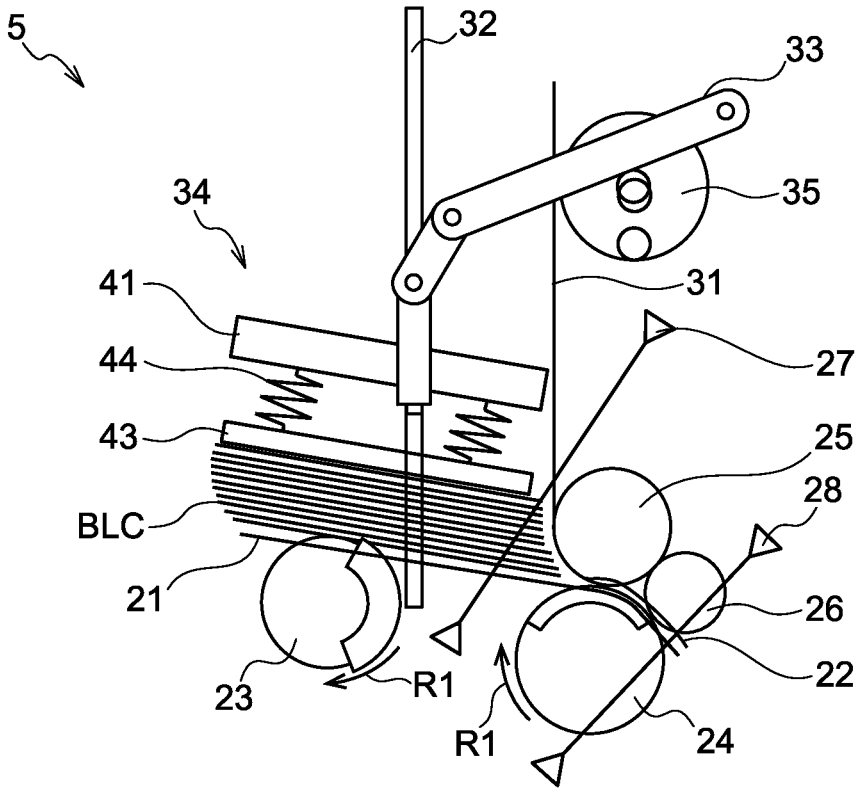
FIG. 18 is a schematic view showing the movement (2) of currency bills in the currency bill feeder of the present invention.

For this reason, in the currency bill holder 34, as shown in FIG. 18, the lower pressing plate 43 can be pushed downward by the restoring force of the springs 44 at a faster speed than when the lower pressing plate 43 freefalls. Because of this, in the currency bill holder 34, the lower pressing plate 43 can be maintained in a state in which it is in contact with the uppermost portion of the stacked currency bills BLC.

That is, in the currency bill holder 34, when the stacked currency bills BLC fall downward, the upper pressing plate 41 substantially remains in its position as is while the lower pressing plate 43 is caused to follow, and without separating from, the stacked currency bills BLC.

Furthermore, in the currency bill holder 34, the position of the upper pressing plate 41 in the front and rear and right and left directions is defined by the slide guides 42. Additionally, in the currency bill holder 34, because of the structural characteristics of the springs 44 and the engagement between the claw-like portions 41BY and the frame-like portions 43C, the lower pressing plate 43 is virtually not moved in the front and rear direction and the right and left direction relative to the upper pressing plate 41.

For this reason, in the currency bill holder 34, the lower pressing plate 43 can be kept in contact with the stacked currency bills BLC, so the upper portion of the stacked currency bills BLC can be kept in position substantially directly under the upper pressing plate 41. Additionally, in the currency bill holder 34, the currency bills BL in the uppermost portion are not caused to stick out frontward.

In this way, in the currency bill feeder 5 of the first embodiment, the lower pressing plate 43 can always be caused, by the springs 44 of the currency bill holder 34, to follow the stacked currency bills BLC that vibrate up and down. For this reason, the currency bill feeder 5 of the first embodiment can maintain the stacked currency bills BLC in a properly stacked state without causing a "currency bill collapse" like the conventional currency bill feeder 405 (see FIG. 9).

[1-5. Selection of Spring Constant]

Figure 19:
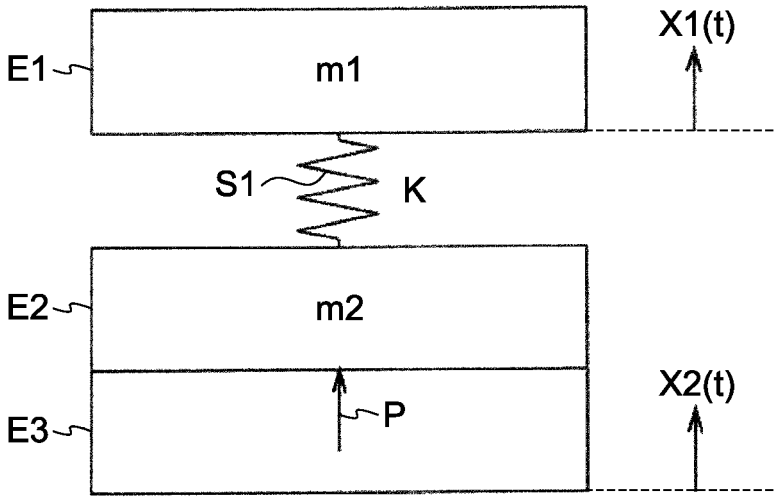
FIG. 19 is a schematic diagram showing a modeled two-degree-of-freedom vibration system.

Next, the selection of the spring constant of the springs 44 will be described. Here, each part of the currency bill holder 34 and the stacked currency bills BLC will be modeled and considered as shown in FIG. 19.

An object E1 on the upper side corresponds to the upper pressing plate 41 and the slide guides 42 (see FIG. 3) and has a mass m1. Furthermore, an object E2 on the lower side corresponds to the lower pressing plate 43 (see FIG. 3) and has a mass m2.

A spring S1 positioned between the object E1 and the object E2 corresponds to the springs 44 (see FIG. 3) and has a spring constant K. Furthermore, under the object E2 there is an object E3 corresponding to the stacked currency bills BLC (see FIG. 18).

The object E3 vibrates at a predetermined period ω and amplitude f (not illustrated), and X1 and X2 denote amounts of displacement of the objects E1 and E2, respectively, from reference positions. The period ωand amplitude f are values that can be decided on the basis of the rotational speed of the picker rollers 23 (see FIG. 4 and FIG. 5) and the projecting distance D1 of the picker portions 23B (see FIG. 5).

If the object E2 is not separated from the object E3, the amplitude of the object E2 becomes f, which is the same as the amplitude of the object E3. However, the amplitude of the object E1 is different from that of the object E2 because of the extension and contraction of the spring S1, so A (not illustrated) will denote the amplitude of the object E1.

Here, a case will be supposed where the forced displacement X2 is applied to the object E3 and a normal force P acts on the object E2 from the object E3. In this case, numerical formulae relating to the balance of force can be configured in regard to the objects E1 and E2 using the forced displacement X2, the masses m1 and m2, the amount of displacement X1, the normal force P, the spring constant K, and the gravitational constant g (not illustrated).

Furthermore, in order for the object E2 to not separate from the object E3, it is necessary that the normal force P be greater than 0. Moreover, the amounts of displacement X1 and X2 can be expressed using the period to, the amplitude f, and the amplitude A.

When these relationships are used to order the numerical formulae, the spring constant K can be expressed by a numerical formula using the masses m1 and m2, the gravitational constant g, the amplitude f, and the period ω. That is, the spring constant K can be specifically calculated by substituting the values of the masses m1 and m2, the gravitational constant g, the amplitude f, and the period ω into the numerical formula for the spring constant K.

The springs 44 are designed to have the spring constant K calculated in this way, so as described above, the lower pressing plate 43 can be caused to follow, and without separating from, the stacked currency bills BLC that vibrate.

[1-6. Actions and Effects]

In the above configuration, as shown in FIG. 18, in the currency bill holder 34 of the currency bill feeder 5 according to the first embodiment, the lower pressing plate 43 is disposed under the upper pressing plate 41 via the springs 44, and the lower pressing plate 43 is pressed against the stacked currency bills BLC.

Here, in the currency bill holder 34, when the stacked currency bills BLC vibrate up and down in accompaniment with the rotation of the picker rollers 23, the upward force applied from the stacked currency bills BLC can be absorbed by the springs 44. Moreover, in the currency bill holder 34, the lower pressing plate 43 can be pressed at a high speed by the restoring force of the springs 44 against the falling stacked currency bills BLC.

For this reason, in the currency bill feeder 5, the lower pressing plate 43 can be kept in contact with the uppermost portion of the stacked currency bills BLC that vibrate up and down, and the currency bill feeder 5 can keep feeding the currency bills BL without causing the stacked currency bills BLC to collapse. Furthermore, in the currency bill feeder 5, the front of the stacking space is open, so the operator can add currency bills BL at any time by lifting up the currency bill holder 34.

In particular, the springs 44 are designed to have the spring constant K appropriately calculated on the basis of the mass of each part and the amplitude and period of vibration, so the lower pressing plate 43 can be reliably caused to follow the uppermost portion of the stacked currency bills BLC.

Furthermore, in the currency bill holder 34, the bend lines of the plate spring portions 44B of the springs 44 are along the front and rear direction, the plate spring portions 44B are disposed on the front and rear sides of the springs 44, and the springs 44 are disposed on the right and left sides. Because of this, in the currency bill holder 34, the lower pressing plate 43 can be rotated in the roll direction and the pitch direction relative to the upper pressing plate 41 (see FIG. 7 and FIG. 8).

For this reason, in the currency bill holder 34, even if the uppermost portion of the stacked currency bills BLC becomes inclined frontward, rearward, rightward, or leftward due to an imbalance resulting from wrinkles or creases in the currency bills BL configuring the stacked currency bills BLC, the lower pressing plate 43 can be caused to follow the stacked currency bills BLC so that the occurrence of a currency bill collapse can be reliably prevented.

Moreover, in the currency bill holder 34, because of the structural characteristics of the springs 44 and the engagement between the claw-like portions 41B and the frame-like portions 43C, the lower pressing plate 43 is virtually not moved in the front and rear direction relative to the upper pressing plate 41.

For this reason, in the currency bill holder 34, even if the number of the stacked currency bills BLC becomes extremely small, the lower pressing plate 43 is not moved rearward by the picker portions 23B of the picker rollers 23. Additionally, in the currency bill holder 34, the occurrence of noise and damage caused by a collision between the lower pressing plate 43 and the mask guide 31 can be prevented beforehand.

Furthermore, in the conventional currency bill feeder 405 (see FIG. 14), if the number of the stacked currency bills BLC becomes relatively small (about several dozen bills), the total mass of the stacked currency bills BLC becomes relatively small but the upward kicking force resulting from the picker portions 23B virtually does not change. For this reason, in the conventional currency bill feeder 405, there have been cases where all of the stacked currency bills BLC end up being kicked up to a great extent so that the currency bills BL in the lowermost portion cannot be picked out rearward.

In contrast to the conventional currency bill feeder 405, in the currency bill feeder 5, the vibration of the stacked currency bills BLC can be absorbed by the springs 44 of the currency bill holder 34, and the lower pressing plate 43 can always be kept in contact with the uppermost portion of the stacked currency bills BLC. Additionally, in the currency bill feeder 5, a situation where all of the stacked currency bills BLC are kicked upward can also be prevented, so it becomes possible to stably pick out the currency bills BL in the lowermost portion.

Moreover, in the conventional currency bill feeder 405, the currency bills BL in the uppermost portion end up being caused to stick out frontward by the vibration of the stacked currency bills BLC, and the amount D3 that the currency bills BL stick out (see FIG. 15) ends up increasing in accordance with the magnitude of the angle of inclination θ. Because of these things, in the conventional currency bill feeder 405, the angle of inclination θ could not be increased. Additionally, in the conventional currency bill feeder 405, the danger that the stacked currency bills BLC will end up falling over frontward is greater when the number of the stacked currency bills BLC has increased, so the number of currency bills BL that can be stacked on the floor guide 21 could not be increased.

In contrast to the conventional currency bill feeder 405, in the currency bill feeder 5, the currency bills BL in the uppermost portion do not end up being caused to stick out frontward even when the stacked currency bills BLC vibrate. For this reason, in the currency bill feeder 5, it becomes possible to increase the angle of inclination θ. Because of this, in the currency bill feeder 5, the danger that the stacked currency bills BLC will end up falling over frontward when the number of stacked currency bills BLC has increased can be significantly reduced, so it becomes possible to increase the stackable number of currency bills BL over the conventional currency bill feeder 405.

Figure 20:
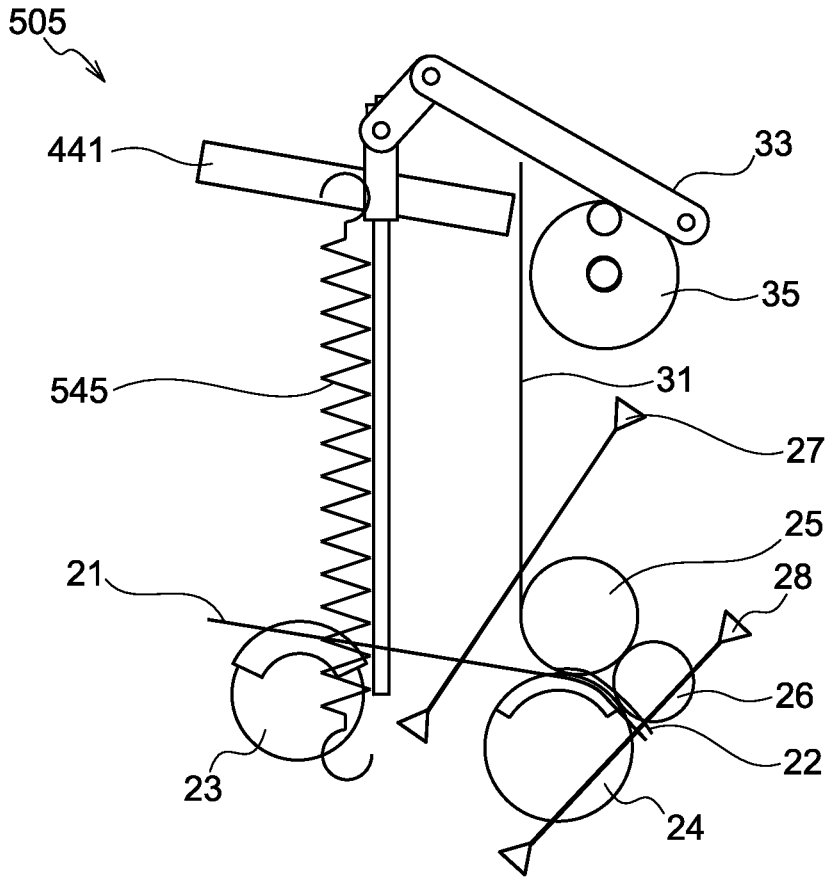
FIG. 20 is a schematic view showing the configuration of a conventional currency bill feeder.

In this connection, as a configuration that utilizes the elastic force of springs to cause the currency bill holder to follow the uppermost portion of the stacked currency bills BLC, a configuration is also conceivable where, like in a currency bill feeder 505 shown in FIG. 20, a pressing plate 441 is pulled downward by the restoring force of springs 545 that have been stretched.

However, in the currency bill feeder 505, the restoring force of the springs 545 always acts on the pressing plate 441. For this reason, in the currency bill feeder 505, when the operator wants to place currency bills BL on the floor guide 21, it is necessary for the operator to use a lot of force to lift up the pressing plate 441, which forces a large burden on the operator.

In particular, in the currency bill feeder 505, if the pressing plate 441 must be separated a great distance from the floor guide 21 in order to stack a large quantity of currency bills BL on the floor guide 21, a restoring force having an intensity corresponding to the distance the pressing plate 441 has been separated from the floor guide 21 occurs in the springs 545. For this reason, in the currency bill feeder 505, an extremely large burden ends up being forced on the operator.

In contrast, in the currency bill feeder 5 of the first embodiment, the elastic force of the springs 44 acts between the upper pressing plate 41 and the lower pressing plate 43. For this reason, in the currency bill feeder 5 of the first embodiment, when the operator lifts up the currency bill holder 34, all the operator has to do is apply a force corresponding to the weight of the currency bill holder 34, regardless of the distance the currency bill holder 34 is lifted. Because of this, in the currency bill feeder 5 of the first embodiment, a burden caused by the elastic force of the springs 44 is not forced on the operator.

According to the above configuration, in the currency bill holder 34 of the currency bill feeder 5 pertaining to the first embodiment, the lower pressing plate 34 is disposed under the upper pressing plate 41 via the springs 44, and the lower pressing plate 43 is pressed against the stacked currency bills BLC. For this reason, in the currency bill holder 34, when the stacked currency bills BLC vibrate up and down in accompaniment with the rotation of the picker rollers 23, the upward force applied from the stacked currency bills BLC is absorbed by the springs 44. Additionally, in the currency bill holder 34, the lower pressing plate 43 is pressed by the restoring force of the springs 44 against the falling stacked currency bills BLC, so the lower pressing plate 43 can be kept in contact with the uppermost portion of the stacked currency bills BLC. Because of this, the currency bill feeder 5 can keep feeding the currency bills BL without causing the stacked currency bills BLC to collapse.

[2. Second Embodiment]

In a second embodiment, a currency bill feeder 105 (see FIG. 3) serving as an example of a media feeding device is used instead of the currency bill feeder 5 according to the first embodiment.

The currency bill feeder 105 differs from the currency bill feeder 5 in that it has a currency bill holder 134 instead of the currency bill holder 34, but other sections of the currency bill feeder 105 are configured in the same way as those of the currency bill feeder 5.

[2-1. Configuration of Currency Bill Holder]

Figure 21:
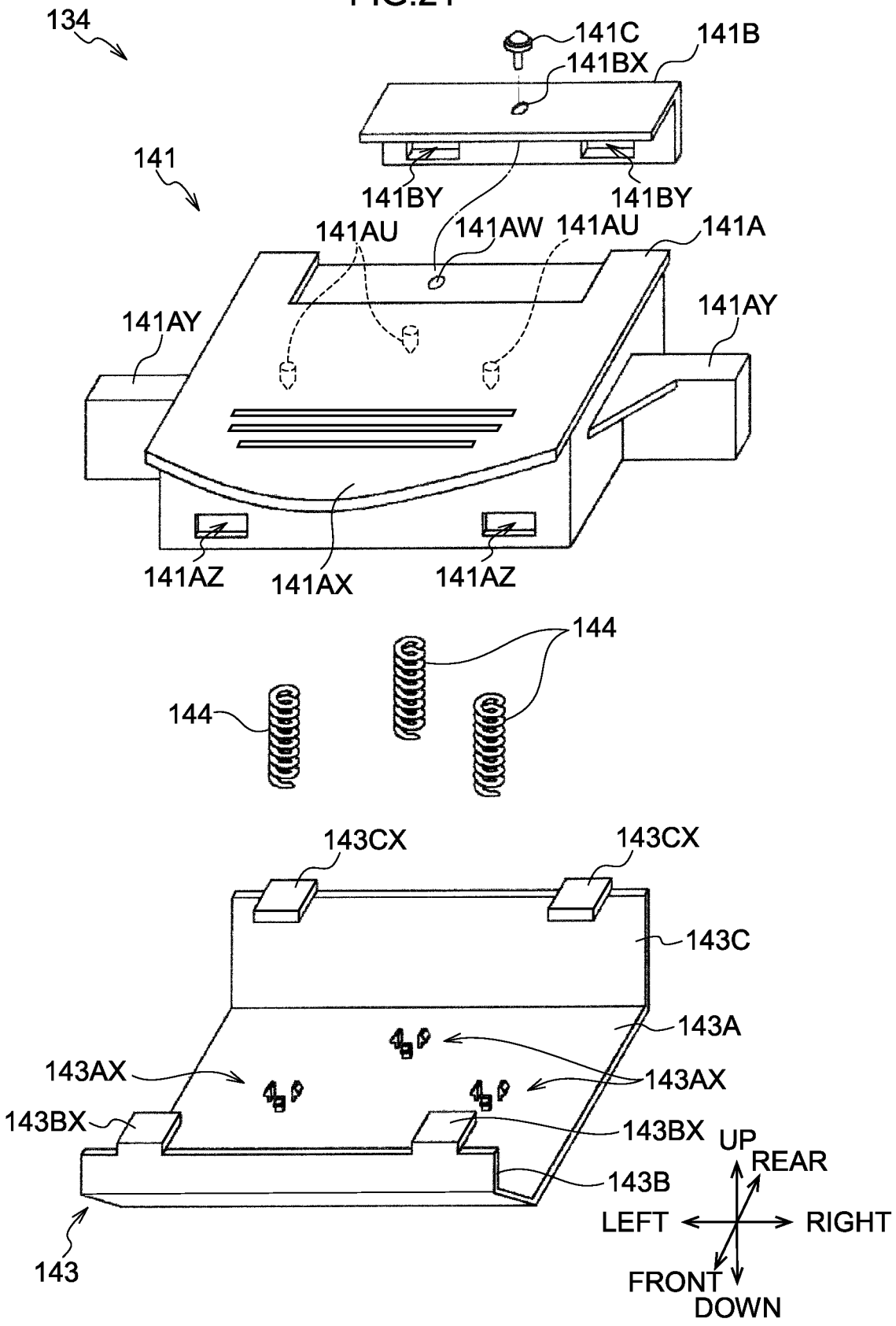
FIG. 21 is a perspective view schematically showing the configuration (1) of a currency bill holder according to a second embodiment.

As shown in FIG. 21, which corresponds to FIG. 6, the currency bill holder 134 differs from the currency bill holder 34 in that it has an upper pressing plate 141 serving as an example of a pressing member, a lower pressing plate 143 serving as an example of an auxiliary pressing member, and springs 144 serving as an example of absorbing members instead of the upper pressing plate 41, the lower pressing plate 43, and the springs 44. The slide guides 42 (see FIG. 6) for the currency bill holder 134 are configured in the same way.

Figure 22:
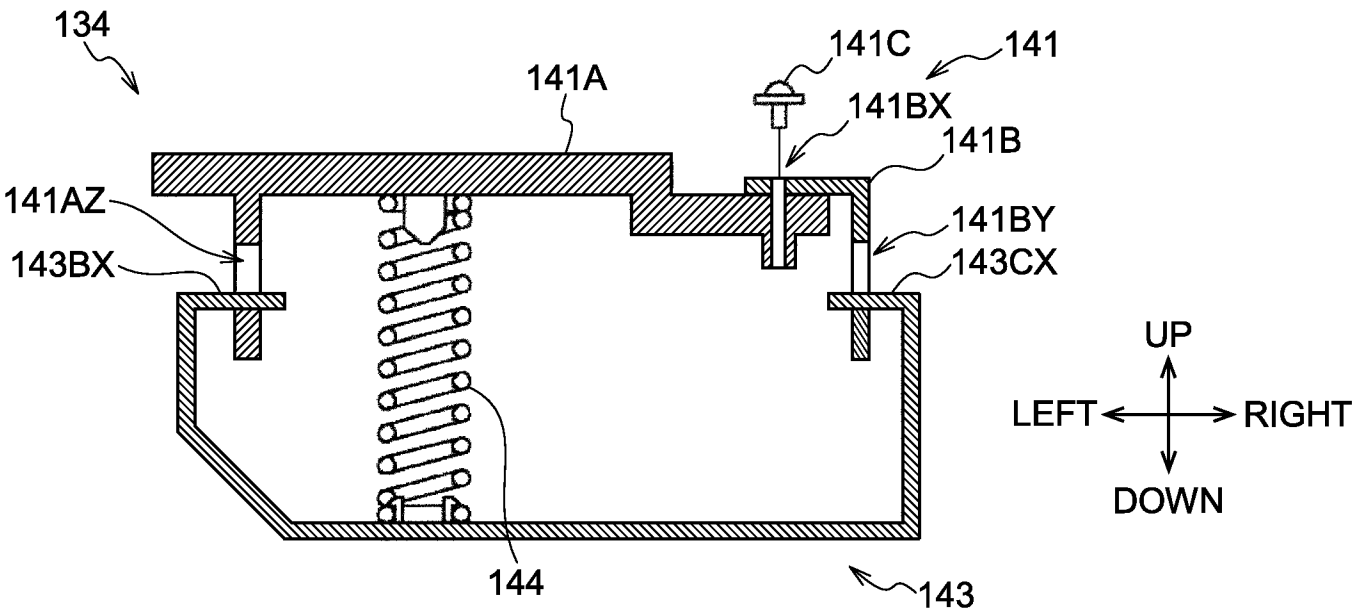
FIG. 22 is a sectional view schematically showing the configuration (2) of the currency bill holder according to the second embodiment.

The upper pressing plate 141 has a front side member 141A serving as an example of a regulating body corresponding to the upper side member 41A. As shown in FIG. 22, the front side member 141A is configured in the shape of a box whose lower surface and rear surface are open. Furthermore, as shown in FIG. 21, the front side member 141A has a grip portion 141AX and attachment portions 141AY that are the same as the grip portion 41AX and the attachment portions 41AY of the upper side member 41A.

Hole portions 141AZ comprising rectangular holes are formed in the front surface of the front side member 141A in places near the lower right and left sides. Furthermore, a screw hole 141AW is formed in the upper surface of the front side member 141A in the right and left direction center near the rear side.

Moreover, projections 141AU for positioning the later-described springs 144 are disposed in three places on the lower surface of an upper side plate of the front side member 141A.

A rear side member 141B is attached to the rear side of the front side member 141A. The rear side member 141B has an upper surface plate and a rear surface plate that are joined together to form an L shape as seen from the right and left direction, and a screw hole 141BX is formed in the vicinity of the center of the upper surface of the rear side member 141B.

Hole portions 141BY comprising rectangular holes that are the same as the hole portions 141AZ of the front side member 141A are formed in the rear surface of the rear side member 141B in places near the lower right and left sides.

The up and down direction length of the hole portions 141AZ and 141BY is longer than the projecting distance D1 (see FIG. 5) of the picker portions 23B of the picker rollers 23.

The lower pressing plate 143 has a base plate 143A configured in the shape of a rectangular thin plate like the base plate 43A of the lower pressing plate 43. Attachment claws 143AX for attaching the later-described springs 144 are disposed upright on the upper surface of the base plate 143A in two places to the right and left near the front and in one place in the center near the rear.

Furthermore, a front surface plate 143B is formed on the base plate 143A as a result of the front side section of the base plate 143A being bent diagonally frontward and upward and then that front side section being bent upward.

Claw-like portions 143BX serving as an example of regulated bodies are disposed on the upper end of the front surface plate 143B in the neighborhoods of both the right and left ends. The claw-like portions 143BX are shaped like small rectangular plates and extend rearward.

A rear surface plate 143C that extends upward is disposed on the rear side of the base plate 143A. Claw-like portions 143CX serving as examples of regulated bodies are disposed on the upper end of the rear surface plate 143C in the neighborhoods of both the right and left ends. The claw-like portions 143CX extend frontward and are configured to be substantially symmetrical to the claw-like portions 143BX in the front and rear direction.

Moreover, the three springs 144 are attached in such a way as to be interposed between the upper pressing plate 141 and the lower pressing plate 143.

The springs 144 are configured as so-called coil springs. Additionally, like the springs 44 in the first embodiment, the springs 144 can cause elastic force to act in the up and down direction between the upper pressing plate 141 and the lower pressing plate 143—that is, the springs 144 can function as elastic bodies.

Furthermore, like in the first embodiment, the compressible length of the springs 144 from their natural state to their most compressed state is greater than the projecting distance D1 (see FIG. 5) of the picker portions 23B of the picker rollers 23. Furthermore, the springs 144 have a spring constant K that is appropriately selected so that the response speed of the springs 144 is sufficiently fast.

As shown in FIG. 22, in the process of assembling the currency bill holder 134, the springs 144 are interposed between the upper pressing plate 141 and the lower pressing plate 143, and the claw-like portions 143BX of the lower pressing plate 143 are inserted into the hole portions 141AZ of the upper pressing plate 141. Moreover, in the process of assembling the currency bill holder 134, the claw-like portions 143CX of the lower pressing plate 143 are inserted into the hole portions 141BY of the upper pressing plate 141.

Then, in the currency bill holder 134, an attachment screw 141C is screwed into the screw hole 141AW in the front side member 141A via the screw hole 141BX in the rear side member 141B.

Because of this, in the currency bill holder 134, the range of movement of the lower side member 143 in the front and rear direction relative to the upper pressing plate 141 is regulated between a position in which the front surface plate 143B contacts the front surface of the front side member 141A and a position in which the rear surface plate 143C contacts the rear surface of the front side member 141B.

Furthermore, in the currency bill holder 134, the range of movement of the lower side member 143 in the right and left direction relative to the upper pressing plate 141 is regulated to the range in which the claw-like portions 143BX and 143CX can move in the hole portions 141AZ and 141BY.

That is, in the currency bill holder 134, like in the first embodiment, the lower pressing plate 143 is positioned roughly directly under the upper pressing plate 141. Additionally, in the currency bill holder 134, the lower pressing plate 143 can be moved or rotated in the range in which the positions and angles of the claw-like portions 143BX and 143CX are regulated by the hole portions 141AZ and 141BY.

At this time, the springs 144 are compressed a certain extent in the up and down direction from their natural state even in a state in which the springs 144 are most extended in the up and down direction as a result of the lower pressing plate 143 being farthest away from the upper pressing plate 141 (see FIG. 22). For this reason, the springs 144 always urge the lower pressing plate 143 downward relative to the upper pressing plate 141.

Figure 23A:
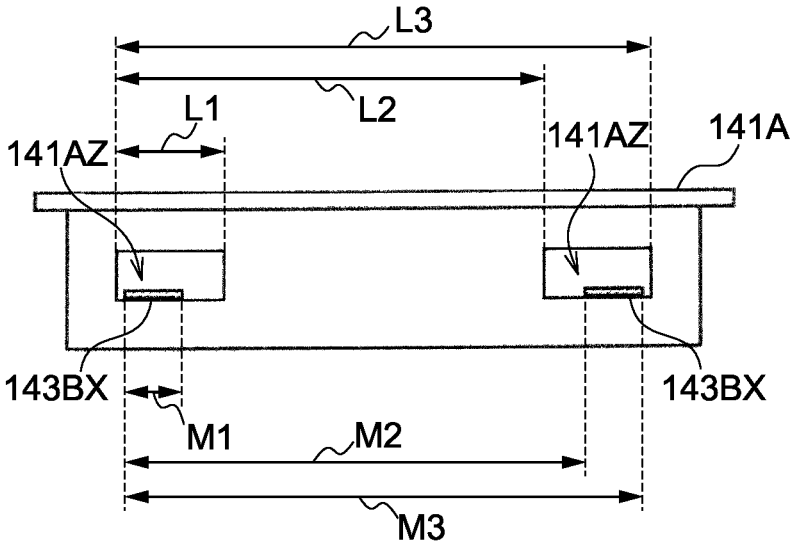
FIG. 23A is a schematic view showing the configuration (3)-A of the currency bill holder according to the second embodiment.

In this connection, in the currency bill holder 134, as shown in FIG. 23A, in relation to the front surface side, a right and left direction length M1 of the claw-like portions 143BX is shorter than a right and left direction length L1 of the hole portions 141AZ.

Furthermore, in the currency bill holder 134, a claw outer-inner distance M2 from the outer end of the claw-like portion 143BX on the left side to the inner end of the claw-like portion 143BX on the right side is longer than a hole outer-inner distance L2 from the outer end of the hole portion 141AZ on the left side to the inner end of the hole portion 141AZ on the right side.

Moreover, in the currency bill holder 134, a claw outer-outer distance M3 from the outer end of the claw-like portion 143BX on the left side to the outer end of the claw-like portion 143BX on the right side is shorter than a hole outer-outer distance L3 from the outer end of the hole portion 141AZ on the left side to the outer end of the hole portion 141AZ on the right side.

Figure 23B:
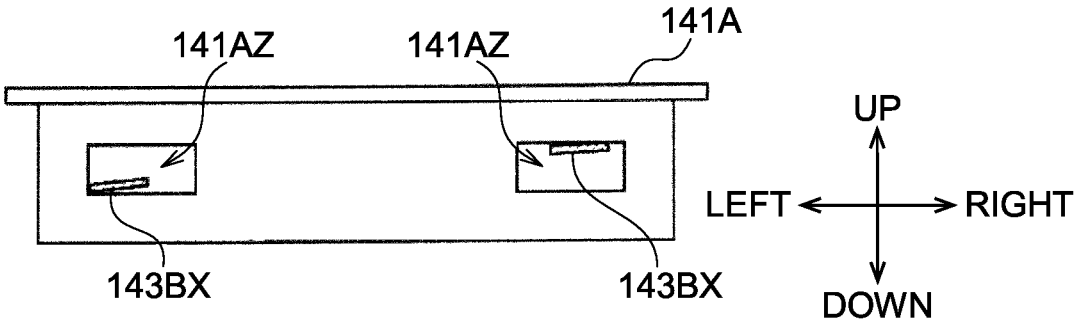
FIG. 23B is a schematic view showing the configuration (3)-B of the currency bill holder according to the second embodiment.

For this reason, in the currency bill holder 134, as shown in FIG. 23B, when the lower pressing plate 143 moves and rotates so that the outer end of the claw-like portion 143BX on the right side is brought into contact with the outer end of the hole portion 141AZ on the right side, the inner end of the claw-like portion 143BX on the right side is separated from the inner end of the hole portion 141AZ on the right side. Furthermore, in the currency bill holder 134, the outer end and inner end of the claw-like portion 143BX on the left side are separated from the outer end and inner end of the hole portion 141AZ on the left side.

Because of this, in the currency bill holder 134, when the lower pressing plate 143 moves or rotates relative to the upper pressing plate 141, the occurrence of a "complication" resulting from the right and left end portions of the claw-like portions 143BX and the right and left end portions of the hole portions 141AZ contacting one another in two or more places at the same time can be avoided.

Furthermore, in the currency bill holder 134, the same distance relationship is also formed between the hole portions 141BY and the claw-like portions 143CX on the rear surface side, so the occurrence of a "complication" can likewise be avoided.

[2-2. Actions and Effects]

In the above configuration, as shown in FIG. 21 and FIG. 22, in the currency bill holder 134 of the currency bill feeder 105 according to the second embodiment, the lower pressing plate 143 is disposed under the upper pressing plate 141 via the springs 144, and the lower pressing plate 143 is pressed against the stacked currency bills BLC (see FIG. 17).

In the currency bill holder 134, when the stacked currency bills BLC vibrate up and down in accompaniment with the rotation of the picker rollers 23 (see FIG. 3), the upward force applied from the stacked currency bills BLC can be absorbed by the springs 144 like in the first embodiment. Moreover, in the currency bill holder 134, the lower pressing plate 143 can be pressed at a high speed by the restoring force of the springs 144 against the falling stacked currency bills BLC.

For this reason, in the currency bill feeder 105, like in the first embodiment, the lower pressing plate 143 can be kept in contact with the uppermost portion of the stacked currency bills BLC that vibrate up and down. Additionally, the currency bill feeder 105 can keep feeding the currency bills BL without causing the stacked currency bills BLC to collapse.

Furthermore, in the currency bill holder 134, the lower pressing plate 143 is virtually not moved in the front and rear direction relative to the upper pressing plate 141 because the front surface plate 143B and the rear surface plate 143C come into contact with the front surface of the front side member 141A and the rear surface of the rear side member 141B, respectively.

For this reason, in the currency bill feeder 105, like in the first embodiment, even if the number of the stacked currency bills BLC becomes extremely small, the lower pressing plate 143 is not moved rearward by the picker portions 23B of the picker rollers 23. Because of this, the occurrence of noise and damage caused by a collision between the lower pressing plate 143 and the mask guide 31 can be prevented beforehand.

Regarding other points also, the currency bill feeder 105 according to the second embodiment can achieve the same action and effects as the currency bill feeder 5 according to the first embodiment.

According to the above configuration, in the currency bill holder 134 of the currency bill feeder 105 according to the second embodiment, the lower pressing plate 143 is disposed under the upper pressing plate 141 via the springs 144, and the lower pressing plate 143 is pressed against the stacked currency bills BLC. For this reason, in the currency bill holder 134, when the stacked currency bills BLC vibrate up and down in accompaniment with the rotation of the picker rollers 23, the upward force applied from the stacked currency bills BLC is absorbed by the springs 144. Additionally, in the currency bill holder 134, the lower pressing plate 143 is pressed against the falling stacked currency bills BLC by the restoring force of the springs 144. For this reason, in the currency bill holder 134, the lower pressing plate 143 can be kept in contact with the uppermost portion of the stacked currency bills BLC, and the currency bills BL can keep being fed without causing the stacked currency bills BLC to collapse.

[3. Third Embodiment]

In a third embodiment, a currency bill feeder 205 (see FIG. 3) serving as an example of a media feeding device is used instead of the currency bill feeder 5 according to the first embodiment.

The currency bill feeder 205 differs from the currency bill feeder 5 in that it has a currency bill holder 234 instead of the currency bill holder 34, but other sections of the currency bill feeder 205 are configured in the same way as those of the currency bill feeder 5.

[3.1 Configuration of Currency Bill Holder]

Figure 24:
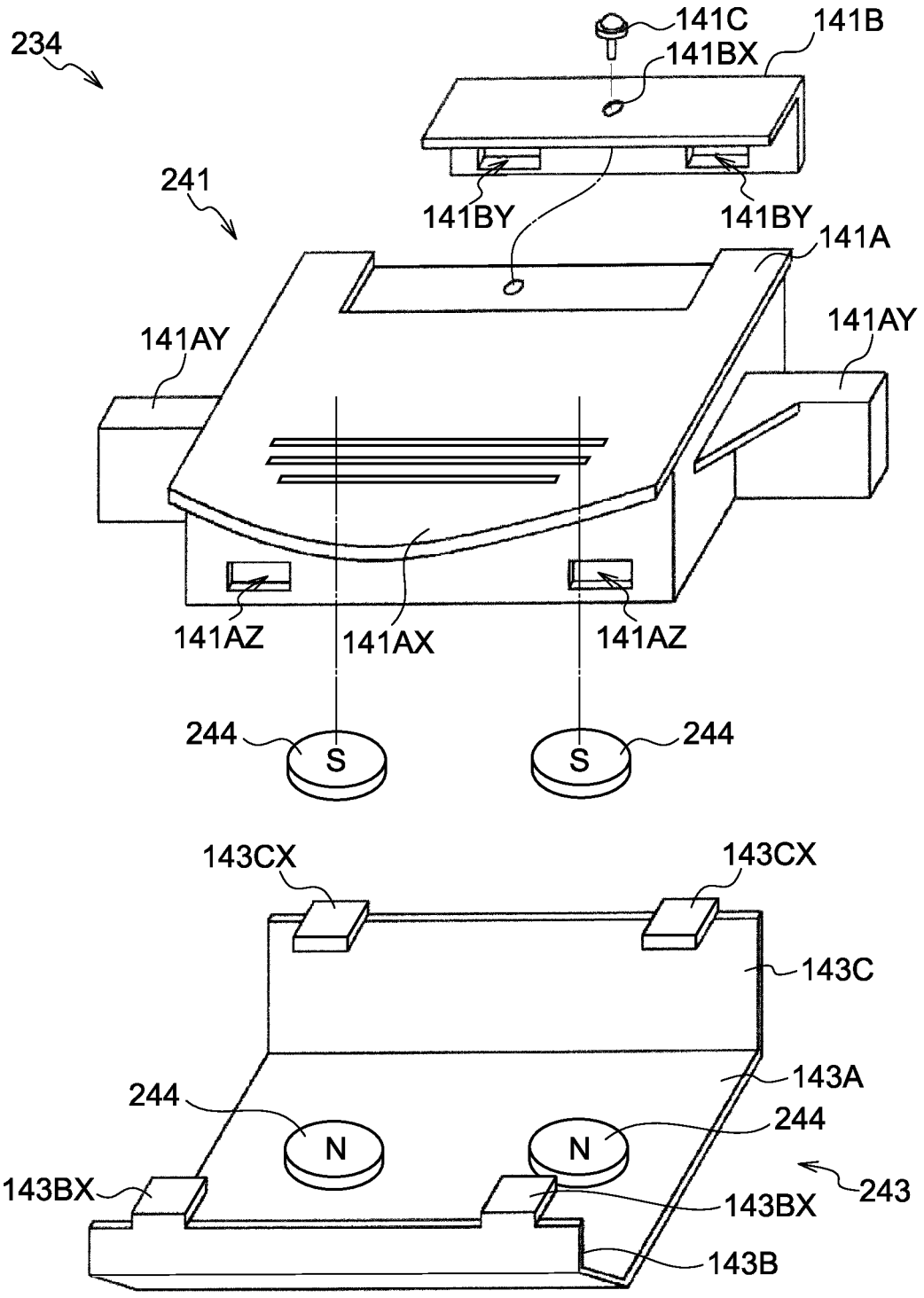
FIG. 24 is a perspective view schematically showing the configuration (1) of a currency bill holder according to a third embodiment.

As shown in FIG. 24, which corresponds to FIG. 6 and FIG. 21, the currency bill holder 234 differs from the currency bill holder 34 in that it has an upper pressing plate 241 serving as an example of a pressing member, a lower pressing plate 243 serving as an example of an auxiliary pressing member, and magnets 244 instead of the upper pressing plate 41, the lower pressing plate 43, and the springs 44. The slide guides 42 (see FIG. 6) for the currency bill holder 234 are configured in the same way.

The upper pressing plate 241 has the same configuration as that of the upper pressing plate 141 of the second embodiment except that the projections 141AU are omitted therefrom. Furthermore, the lower pressing plate 243 has the same configuration as that of the lower pressing plate 143 of the second embodiment except that the attachment claws 143AX are omitted therefrom.

The magnets 244 are attached, two each in mutually opposing positions, to the lower surface of the upper side plate of the front side member 141A and the upper surface of the base plate 143A.

The distance between the mutually opposing magnets 244 is greater than the projecting distance D1 (see FIG. 5) of the picker portions 23B of the picker rollers 23 (see FIG. 3).

Figure 25:
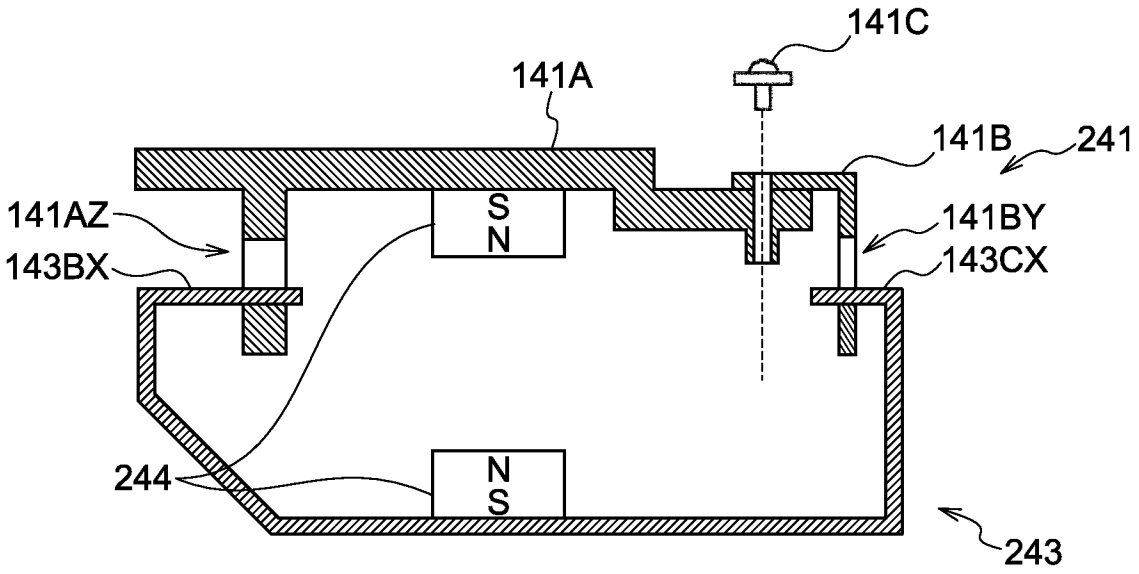
FIG. 25 is a sectional view schematically showing the configuration (2) of the currency bill holder according to the third embodiment.

As shown in FIG. 25, the magnets 244 are attached in such a way that the same poles (e.g., the N poles) oppose one another, so the magnets 244 repel one another and cause a repulsive force to act between them.

For this reason, in the currency bill holder 234, like in the second embodiment, the lower pressing plate 243 can always be urged downward relative to the upper pressing plate 241.

[3-2. Actions and Effects]

In the above configuration, in the currency bill holder 234 of the currency bill feeder 205 according to the third embodiment, the lower pressing plate 243 is disposed under the upper pressing plate 241 with the magnets 244 being interposed between them, and the lower pressing plate 243 is pressed against the stacked currency bills BLC.

In the currency bill holder 234, when the stacked currency bills BLC vibrate up and down in accompaniment with the rotation of the picker rollers 23, the upward force applied from the stacked currency bills BLC can be absorbed by the repulsive force of the magnets 244 in the same way as in the first embodiment. Moreover, in the currency bill holder 234, the lower pressing plate 243 can be pressed at a high speed against the falling stacked currency bills BLC by the repulsive force of the magnets 244.

For this reason, in the currency bill feeder 205, like in the first embodiment, the lower pressing plate 243 can be kept in contact with the uppermost portion of the stacked currency bills BLC that vibrate up and down, and the currency bill feeder 205 can keep feeding the currency bills BL without causing the stacked currency bills BLC to collapse.

Regarding other points also, the currency bill feeder 205 according to the third embodiment can achieve the same action and effects as the currency bill feeder 5 according to the first embodiment.

According to the above configuration, in the currency bill holder 234 of the currency bill feeder 205 according to the third embodiment, the lower pressing plate 243 is disposed under the upper pressing plate 241 with the magnets 244 being interposed between them, and the lower pressing plate 243 is pressed against the stacked currency bills BLC. For this reason, in the currency bill holder 234, when the stacked currency bills BLC vibrate up and down in accompaniment with the rotation of the picker rollers 23, the upward force applied from the stacked currency bills BLC is absorbed by the repulsive force of the magnets 244. Additionally, in the currency bill holder 234, the lower pressing plate 243 is pressed by the repulsive force of the magnets 244 against the falling stacked currency bills BLC. Because of this, in the currency bill holder 234, the lower pressing plate 243 can be kept in contact with the uppermost portion of the stacked currency bills BLC, and the currency bills BL can keep being fed without causing the stacked currency bills BLC to collapse.

[4. Fourth Embodiment]

In a fourth embodiment, a currency bill feeder 305 (see FIG. 3) serving as an example of a media feeding device is used instead of the currency bill feeder 5 according to the first embodiment.

The currency bill feeder 305 differs from the currency bill feeder 5 in that it has a currency bill holder 334 instead of the currency bill holder 34, but other sections of the currency bill feeder 305 are configured in the same way as those of the currency bill feeder 5.

[4-1. Configuration of Currency Bill Holder]

Figure 26:
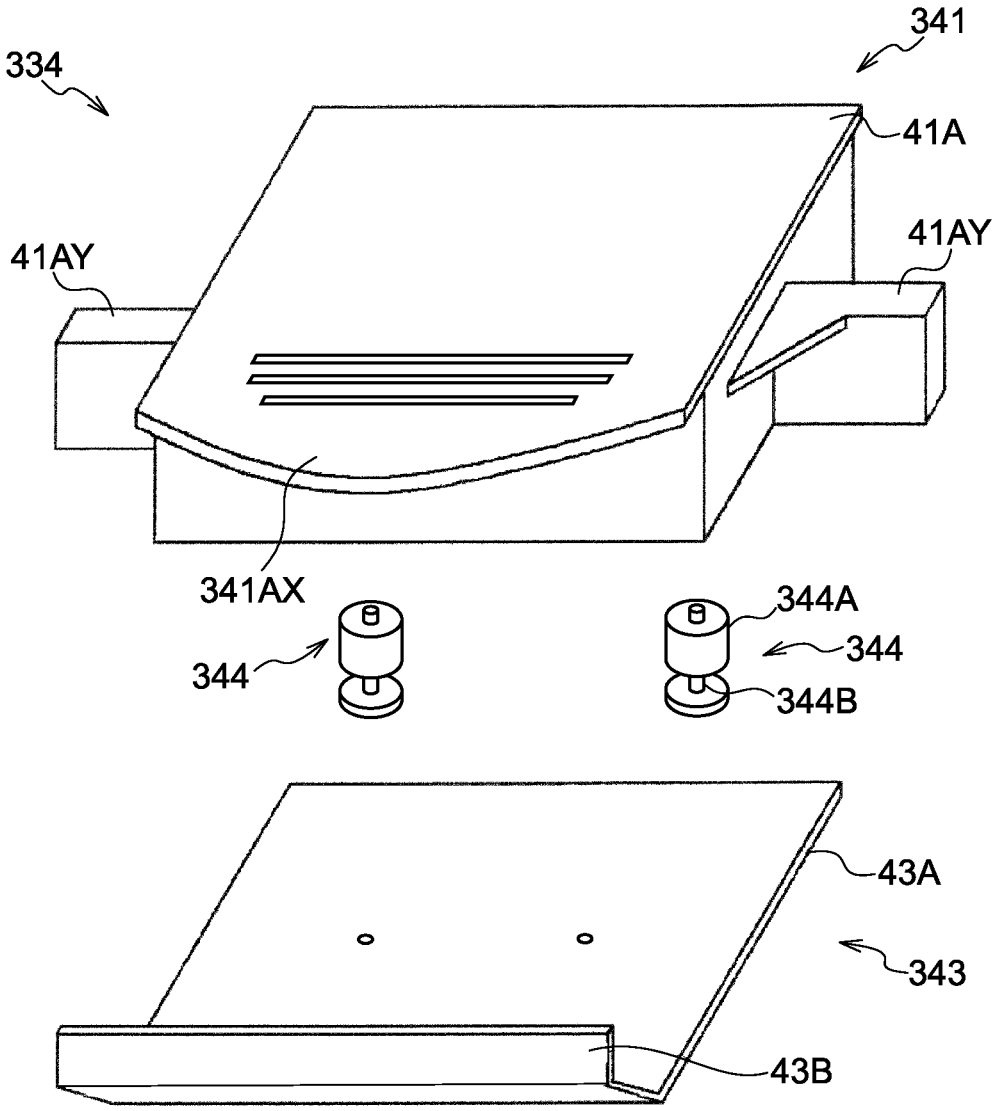
FIG. 26 is a perspective view schematically showing the configuration (1) of a currency bill holder according to a fourth embodiment.

As shown in FIG. 26, which corresponds to FIG. 6, the currency bill holder 334 differs from the currency bill holder 34 in that it has an upper pressing plate 341 serving as an example of a pressing member, a lower pressing plate 343 serving as an example of an auxiliary pressing member, and air suspensions 344 instead of the upper pressing plate 41, the lower pressing plate 43, and the springs 44. The slide guides 42 (see FIG. 6) for the currency bill holder 334 are configured in the same way.

The upper pressing plate 341 has the same configuration as that of the upper pressing plate 41 of the first embodiment except that the lower side member 41B is omitted therefrom, so the upper pressing plate 341 is configured by just the upper side member 41A. Furthermore, the lower pressing plate 343 has the same configuration as that of the lower pressing plate 43 of the first embodiment except that the frame-like portions 43C are omitted therefrom, so the lower pressing plate 343 is configured by just the base plate 43A and the front surface plate 43B.

The air suspensions 344 are attached, one each to the right and left, between the lower surface of the upper side member 41A of the upper pressing plate 341 and the upper surface of the base plate 43A of the lower pressing plate 343.

Figure 27:
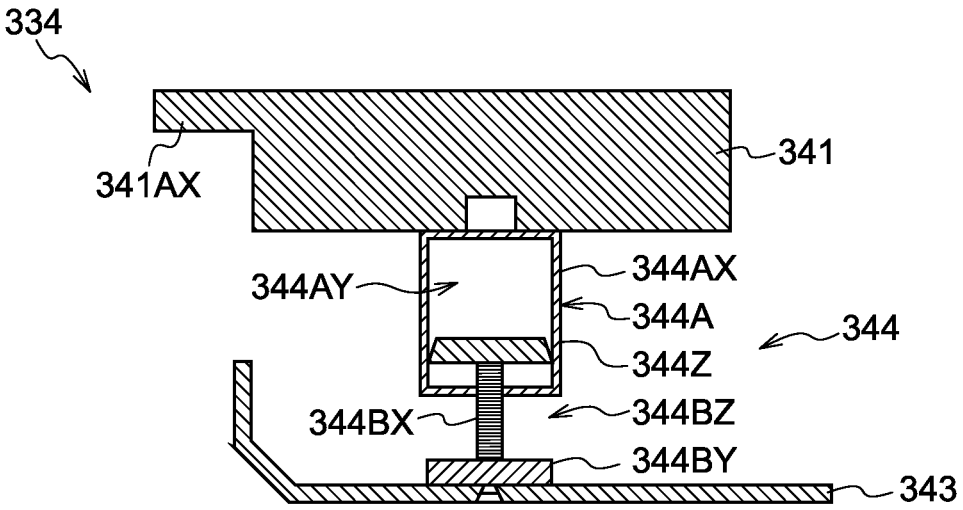
FIG. 27 is a sectional view schematically showing the configuration (2) of the currency bill holder according to the fourth embodiment.

As shown in FIG. 27, each of the air suspensions 344 is configured by an upper side portion 344A and a lower side portion 344B.

The upper side portion 344A has a cylinder portion 344AX comprising a cylinder in which a cylindrical space is formed, and a top plate of the cylinder portion 344AX is attached to the lower surface of the upper side member 41A. Furthermore, a circular hole is formed in the center of a bottom plate of the cylinder portion 344AX.

The lower side portion 344B has a cylindrical shaft 344BX that is long and narrow in the up and down direction. The shaft 344BX is inserted into the circular hole formed in the bottom plate of the cylinder portion 344AX. Furthermore, the lower side portion 344B is secured to the upper surface of the lower pressing plate 43 via a discoid attachment plate 344BY attached to the lower end of the shaft 344BX.

A discoid piston 344BZ is attached to the upper end of the shaft 344BX. The piston 344BZ has an outer diameter that is substantially equal to the inner diameter of the cylinder portion 344AX. Furthermore, the piston 344BZ is in substantially tight contact with the inner wall of the cylinder portion 344AX to thereby form a substantially sealed space 344AY on the upper side of the space inside the cylinder portion 344AX. Moreover, the piston 344BZ can move up and down inside the cylinder portion 344AX.

The distance from the upper surface of the piston 344BZ to the lower surface of the top plate of the cylinder portion 344AX is greater than the projecting distance D1 (see FIG. 5) of the picker portions 23B of the picker rollers 23.

Because of this configuration, the lower side portions 344B of the air suspensions 344 can be moved up and down relative to the upper side portions 344A. At this time, the air suspensions 344 produce the same restoring force (repelling force) as a spring as a result of the air sealed inside the sealed space 344AY being compressed or expanded.

In this way, like the springs 44 in the first embodiment, the air suspensions 344 can cause an elastic force to act in the up and down direction between the upper pressing plate 141 and the lower pressing plate 143—that is, the air suspensions 344 can function as elastic bodies.

Furthermore, because of the structure of the air suspensions 344, the lower side portions 344B virtually cannot be moved in the front and rear direction or the right and left direction relative to the upper side portions 344A. For this reason, in the currency bill holder 334, the movement of the lower pressing plate 343 in the front and rear direction and the right and left direction relative to the upper pressing plate 341 is restricted to an extremely limited range.

[4-2. Actions and Effects]

In the above configuration, in the currency bill holder 334 of the currency bill feeder 305 according to the fourth embodiment, the lower pressing plate 343 is disposed under the upper pressing plate 341 with the air suspensions 344 being interposed between them, and the lower pressing plate 343 is pressed against the stacked currency bills BLC.

In the currency bill holder 334, when the stacked currency bills BLC vibrate up and down in accompaniment with the rotation of the picker rollers 23, the upward force applied from the stacked currency bills BLC can be absorbed by the air suspensions 344 in the same way as in the first embodiment. Moreover, in the currency bill holder 334, the lower pressing plate 343 can be pressed at a high speed by the repelling force of the air suspensions 344 against the falling stacked currency bills BLC.

For this reason, in the currency bill feeder 305, like in the first embodiment, the lower pressing plate 343 can be kept in contact with the uppermost portion of the stacked currency bills BLC that vibrate up and down, and the currency bill feeder 305 can keep feeding the currency bills BL without causing the stacked currency bills BLC to collapse.

Regarding other points also, the currency bill feeder 305 according to the fourth embodiment can achieve the same action and effects as the currency bill feeder 5 according to the first embodiment.

According to the above configuration, in the currency bill holder 334 of the currency bill feeder 305 according to the fourth embodiment, the lower pressing plate 343 is disposed under the upper pressing plate 341 with the air suspensions 344 being interposed between them, and the lower pressing plate 343 is pressed against the stacked currency bills BLC. For this reason, in the currency bill holder 334, when the stacked currency bills BLC vibrate up and down in accompaniment with the rotation of the picker rollers 23, the upward force applied from the stacked currency bills BLC is absorbed by the air suspensions 344. Additionally, in the currency bill holder 334, the lower pressing plate 343 is pressed by the repelling force of the air suspensions 344 against the falling stacked currency bills BLC. Because of this, in the currency bill feeder 305, the lower pressing plate 343 can be kept in contact with the uppermost portion of the stacked currency bills BLC, and the currency bill feeder 305 can keep feeding the currency bills BL without causing the stacked currency bills BLC to collapse.

[5. Fifth Embodiment]

In a fifth embodiment, a currency bill feeder 605 (see FIG. 3) serving as an example of a media feeding device is used instead of the currency bill feeder 5 according to the first embodiment.

The currency bill feeder 605 differs from the currency bill feeder 5 in that it has a currency bill holder 634 instead of the currency bill holder 34, but other sections of the currency bill feeder 605 are configured in the same way as those of the currency bill feeder 5.

[5-1. Configuration of Currency Bill Holder]

Figure 28:
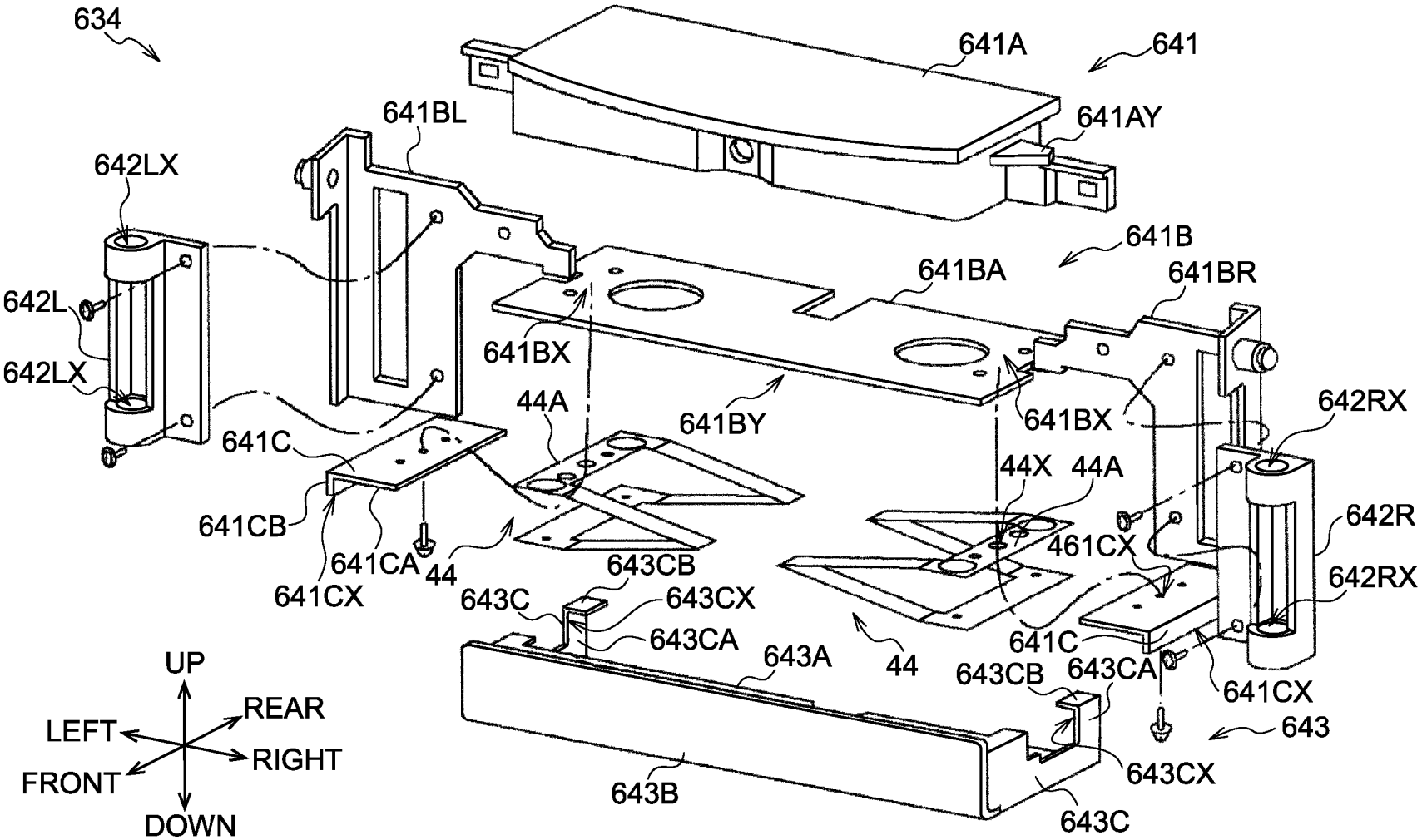
FIG. 28 is a perspective view schematically showing the configuration (1) of a currency bill holder according to a fifth embodiment.

As shown in FIG. 28, which corresponds to FIG. 6, the currency bill holder 634 differs from the currency bill holder 34 in that it has an upper pressing plate 641 serving as an example of a pressing member, bearing portions 642L and 642R, and a lower pressing plate 643 serving as an example of an auxiliary pressing member instead of the upper pressing plate 41, the slide guides 42, and the lower pressing plate 43, but the springs 44 (see FIG. 6) are configured in the same way.

The upper pressing plate 641 is configured by an upper side member 641A that corresponds to the upper side member 41A in the first embodiment, a lower side member 641B that corresponds to the lower side member 41B and the base plates 42L and 42R of the left and right slide guides 42, and right and left attachment members 641C for attaching the springs 44.

The upper side member 641A is configured in substantially the same way as the upper side member 41A according to the first embodiment, and attachment portions 641AY corresponding to the attachment portions 41AY are disposed on both the right and left side surfaces of the upper side member 641A.

The lower side member 641B comprises, for example, thin plate-like metal plates subjected to various processing treatments such as cutting and bending. Additionally, the lower side member 641B is configured to include a central base plate 641BA, which serves as an example of a regulating body corresponding to the lower side member 41B in the first embodiment, and slide base plates 641BL and 641BR, which correspond to the base plates 42L and 42R of the slide guides 42.

The central base plate 641BA comprises a thin plate that is long in the right and left direction, short in the front and rear direction, and thin in the up and down direction like the lower side member 41B, but the claw-like portions 41BY are omitted therefrom. Furthermore, joint portions that join to the slide base plates 641BL and 641BR and projecting portions that project rightward and leftward are formed on the right and left sides of the central base plate 641BA.

The slide base plates 641BL and 641BR are configured in substantially the same way as the slide guides 42. That is, like the base plate 42L, the slide base plate 641BL on the left side comprises a thin plate with a vertically inverted L shape as seen from the front, and a reinforcement plate that extends frontward is disposed on the left side edge of the slide base plate 641BL. Furthermore, the bearing portion 642L, which has a shape in which the two bearing portions 42A (see FIG. 6) are coupled together in the up and down direction by a coupling member having a predetermined shape, is attached to the left side of the front surface of the slide base plate 641BL by predetermined attachment screws. Insertion holes 642LX, which have an inner diameter that is slightly larger than the outer diameter of the slide shafts 32 (see FIG. 3) and penetrate the bearing portion 642L in the up and down direction, are formed in the upper and lower portions of the bearing portion 642L.

Like the insertion holes 42AX, the inside surfaces of the insertion holes 642LX are smoothly formed so that sliding friction is kept low.

Furthermore, the slide base plate 641BR and the bearing portion 642R on the right side are configured to be substantially symmetrical in the right and left direction to the slide base plate 641BL and the bearing portion 642L on the left side. Insertion holes 642RX are formed in the upper and lower portions of the bearing portion 642R.

The right and left attachment members 641C are configured to be symmetrical to one another in the right and left direction. Here, the attachment member 641C on the left side will be described and description of the attachment member 641C on the right side will be omitted.

The attachment member 641C on the left side is a member comprising a rectangular flat plate that is long in the front and rear direction, with the neighborhood of the left edge of that member being bent downward. Because of this, the attachment member 641C has a shape wherein a support portion 641CB comprising a substantially vertical flat plate extends downward from the left end of an attachment portion 641CA comprising a substantially horizontal flat plate—that is, the attachment member 641C has a shape that looks like an "L" rotated 90 degrees in the clockwise direction as seen from the front direction.

Screw holes that penetrate the attachment portion 641CA of the attachment member 641C in the up and down direction are formed in the neighborhood of the front and rear direction center of the attachment portion 641CA. Furthermore, screw holes that penetrate the attachment portions 44A on the upper sides of the springs 44 are also formed in those attachment portions 44A.

The lower pressing plate 643 differs from the lower pressing plate 43 in the first embodiment in that it is disposed with side plate portions 643C serving as an example of regulated bodies instead of the frame-like portions 43C, but the lower pressing plate 643 has a base plate 643A and a front surface plate 643B that are configured in substantially the same way as the base plate 43A and the front surface plate 43B of the lower pressing plate 43.

The side plate portions 643C have plate-like vertical portions 643CA that are disposed extending upward from the neighborhoods of both the right and left direction ends of the base plate 643A. Moreover, the side plate portions 643C have a shape disposed with short plate-like claw-like portions 643CB that extend inward in the right and left direction from the neighborhoods of the upper ends of the side plate portions 643C. Furthermore, the upper side sections of the side plate portions 643C in the neighborhoods of the front and rear direction centers—that is, the sections of the side plate portions 643C corresponding to the attachment portions 641AY of the upper side member 641A—are cut out to a great extent.

When the currency bill holder 634 is to be assembled, the attachment portions 44A on the upper sides of the springs 44 are interposed between the lower surface of the central base plate 641BA and the attachment portions 641CA of the attachment members 641C. Then, in the currency bill holder 634, predetermined attachment screws are fastened to the attachment portions 44A to thereby secure the springs 44 and the attachment members 641C to the lower surface of the central base plate 641BA. Furthermore, in the currency bill holder 634, predetermined attachment screws are used to secure the bearing portions 642L and 642R to the slide base plates 641BL and 641BR.

Figure 29:
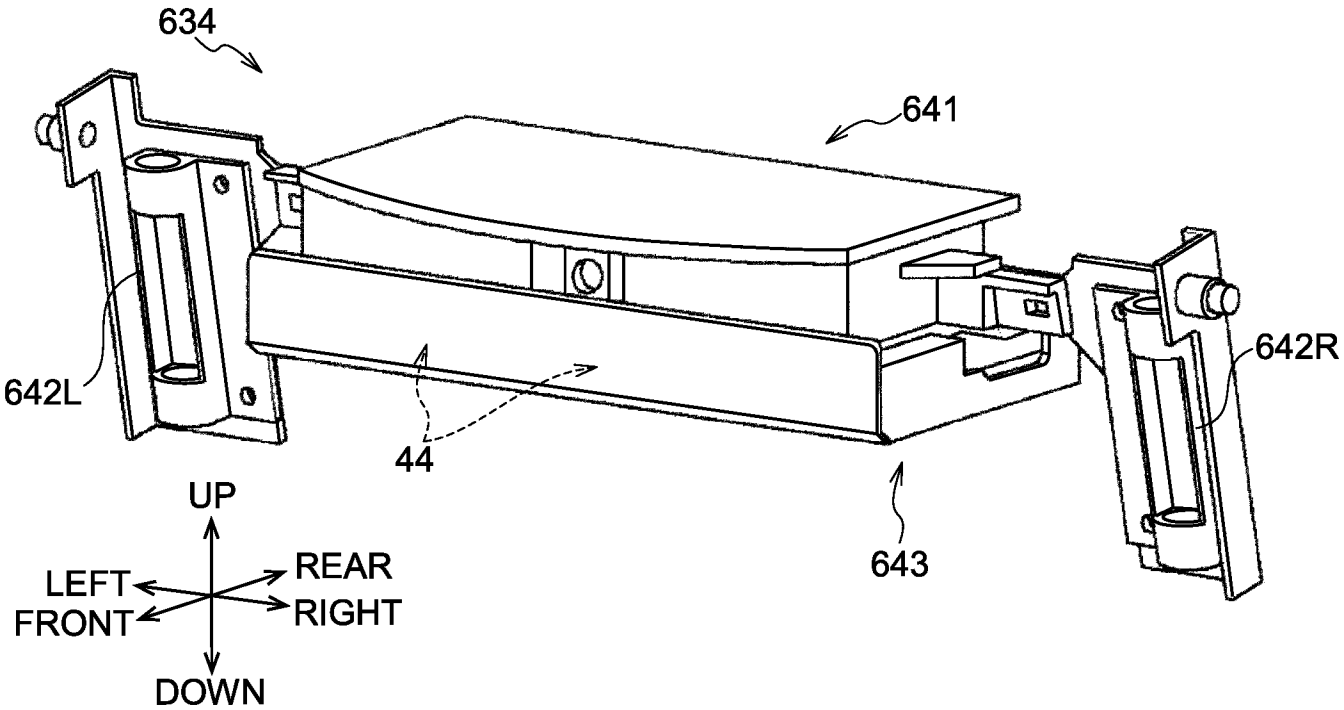
FIG. 29 is a sectional view schematically showing the configuration (2) of the currency bill holder according to the fifth embodiment.

Moreover, as shown in FIG. 28, the currency bill holder 634 is assembled in such a way that the base plate 643A is positioned substantially directly under the central base plate 641BA and the claw-like portions 643CB of the lower pressing plate 643 are disposed on the upper side of the central base plate 641BA. At this time, the springs 44 become compressed a certain extent from their natural length between the base plate 643A and the central base plate 641BA. In this way, as shown in FIG. 29, the currency bill holder 634 is assembled.

Figure 30A:
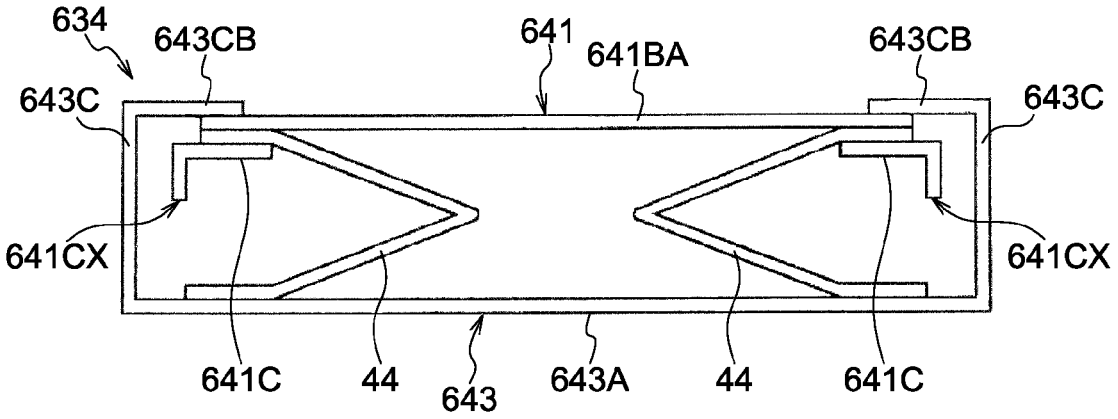
FIG. 30A is a schematic view (1) showing the movement of a lower pressing plate in the currency bill holder according to the fifth embodiment.

Here, in the currency bill holder 634, when an external force is not being applied to the lower pressing plate 643, the lower pressing plate 643 is separated from the upper pressing plate 641 by the restoring force of the springs 44. Additionally, as schematically shown in FIG. 30A, in the currency bill holder 634, the claw-like portions 643CB are in contact with the central base plate 641BA.

Figure 30B:
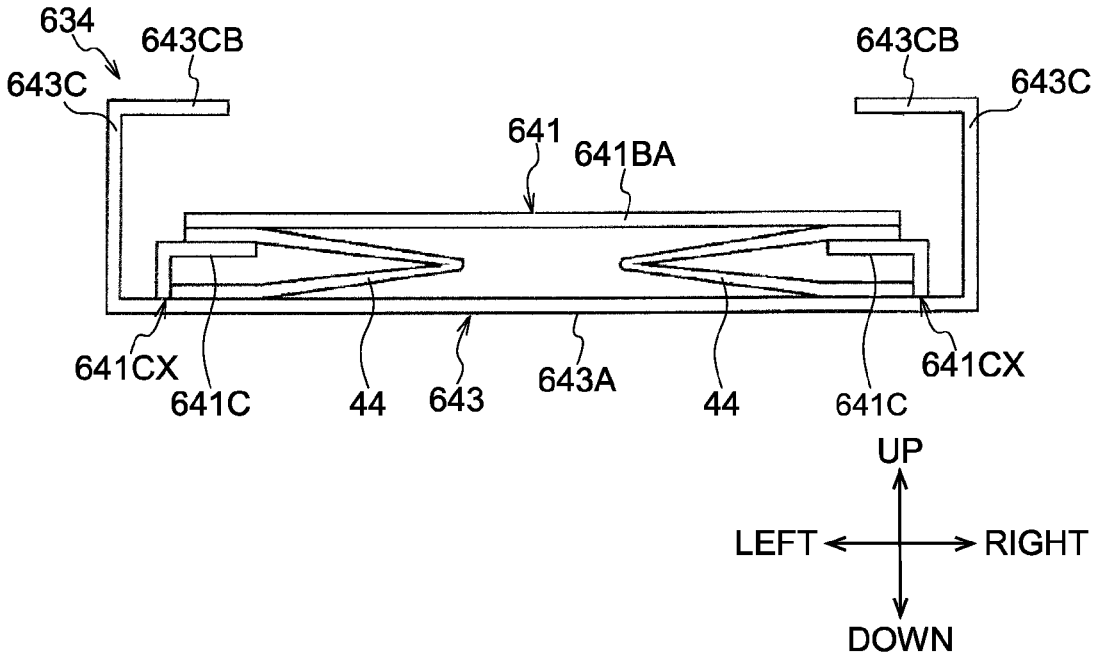
FIG. 30B is a schematic view (2) showing the movement of the lower pressing plate in the currency bill holder according to the fifth embodiment.

Furthermore, in the currency bill holder 634, when an upward external force is applied to the lower pressing plate 643, the springs 44 become compressed and the lower pressing plate 643 is moved closer to the upper pressing plate 641. Additionally, as schematically shown in FIG. 30B, in the currency bill holder 634, lower ends 641CX of the supports portions 641CB of the attachment members 641C are brought into contact with the upper surface of the base plate 643A.

That is, the lower pressing plate 643 can be moved in the up and down direction between a state in which the claw-like portions 643CB contact the central base plate 641BA and a state in which the base plate 643A contacts the lower ends 641CX of the support portions 641CB.

Furthermore, in the currency bill holder 634, like in the first embodiment, the lower pressing plate 643 can not only be moved in the up and down direction relative to the upper pressing plate 641 but can also be rotated in the pitch direction about an axis running along the right and left direction. Or, in the currency bill holder 634, the lower pressing plate 643 can also be rotated in the yaw direction about an axis running along the front and rear direction relative to the upper pressing plate 641.

Figure 31:
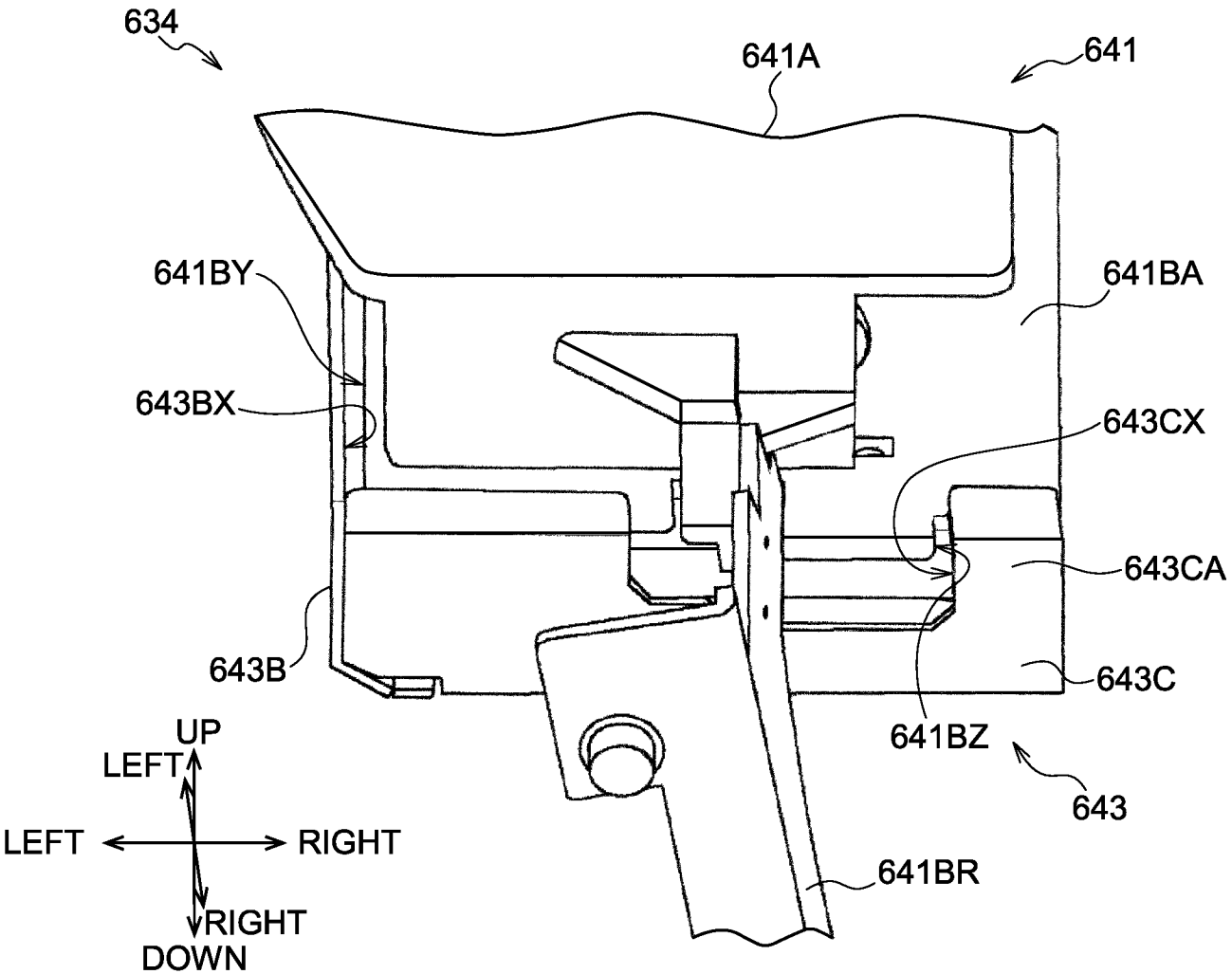
FIG. 31 is a sectional view schematically showing the configuration (3) of the currency bill holder according to the fifth embodiment.

In the currency bill holder 634, part of which is enlarged and shown in FIG. 31, a slight gap in the front and rear direction is formed between a front end portion 641BY of the central base plate 641BA of the upper pressing plate 641 and a rear surface 643BX of the front surface plate 643B of the lower pressing plate 643.

Furthermore, in the currency bill holder 634, a slight gap in the front and rear direction is also formed between rear end portions 641BZ of the projecting portions projecting rightward and leftward from the central base plate 641BA of the upper pressing plate 641 and front side surfaces 643CX of the vertical portions 643CA of the lower pressing plate 643.

For this reason, the range of movement of the lower pressing plate 643 in the front and rear direction is regulated between a state in which the rear surface 643BX of the front surface plate 643B contacts the front end portion 641BY and a state in which the front side surfaces 643CX contact the rear end portions 641BZ.

Moreover, like in the first embodiment, the fold lines of the bent sections of the springs 44 interposed between the lower pressing plate 643 and the upper pressing plate 641 are along the front and rear direction. For this reason, like in the first embodiment, the lower pressing plate 643 is virtually not moved in the front and rear direction relative to the upper pressing plate 641.

Furthermore, the range of movement of the lower pressing plate 643 in the right and left direction is regulated as a result of the inside surfaces of the vertical portions 643CA of the lower pressing plate 643 and both the right and left direction ends of the central base plate 641BA of the upper pressing plate 641 contacting one another.

That is, the amounts of movement of the lower pressing plate 643 in the front and rear direction and the right and left direction relative to the upper pressing plate 641 are regulated in such a way that both are slight.

In this way, in the currency bill holder 634, like in the first embodiment, the lower pressing plate 643 is disposed under the upper pressing plate 641 with the springs 44 being interposed between them. Because of this, in the currency bill holder 634, elastic force acts on the lower pressing plate 643 from the upper pressing plate 641, and the lower pressing plate 643 is moved in the up and down direction or rotated in the pitch direction or the yaw direction.

[5-2. Actions and Effects]

In the above configuration, in the currency bill holder 634 of the currency bill feeder 605 (see FIG. 3) according to the fifth embodiment, the lower pressing plate 643 is disposed under the upper pressing plate 641 with the springs 44 being interposed between them, and the lower pressing plate 643 is pressed against the stacked currency bills BLC.

In the currency bill holder 634, when the stacked currency bills BLC vibrate up and down in accompaniment with the rotation of the picker rollers 23 (see FIG. 3), the upward force applied from the stacked currency bills BLC can be absorbed by the springs 44 like in the first embodiment. Moreover, in the currency bill holder 634, the lower pressing plate 643 can be pressed at a high speed by the repelling force of the springs 44 against the falling stacked currency bills BLC.

For this reason, in the currency bill feeder 605, like in the first embodiment, the lower pressing plate 643 can be kept in contact with the uppermost portion of the stacked currency bills BLC vibrating up and down, and the currency bill feeder 605 can keep feeding the currency bills BL without causing the stacked currency bills BLC to collapse.

Regarding other points also, the currency bill feeder 605 according to the fifth embodiment can achieve the same action and effects as the currency bill feeder 5 according to the first embodiment.

According to the above configuration, in the currency bill holder 634 of the currency bill feeder 605 according to the fifth embodiment, the lower pressing plate 643 is disposed under the upper pressing plate 641 with the springs 44 being interposed between them, and the lower pressing plate 643 is pressed against the stacked currency bills BLC. For this reason, in the currency bill holder 634, when the stacked currency bills BLC vibrate up and down in accompaniment with the rotation of the picker rollers 23, the upward force applied from the stacked currency bills BLC is absorbed by the springs 44. Additionally, in the currency bill holder 634, the lower pressing plate 643 can be pressed by the repelling force of the springs 44 against the falling stacked currency bills BLC. Because of this, in the currency bill feeder 605, the lower pressing plate 643 can be kept in contact with the uppermost portion of the stacked currency bills BLC, and the currency bill feeder 605 can keep feeding the currency bills BL without causing the stacked currency bills BLC to collapse.

[6. Other Embodiments]

In the first to fifth embodiments, cases were described where the springs 44 comprising plate springs, the springs 144 comprising coil springs, the magnets 244, or the air suspensions 344 were disposed between the upper pressing plate 41 etc. and the lower pressing plate 43 etc.

However, the present invention is not limited to this; for example, a variety of elastic bodies such as various types of springs and rubber, or materials that absorb shock such as sponges or cushions, or appropriate combinations of these may also be disposed between the upper pressing plate 41 etc. and the lower pressing plate 43 etc. In this case, it is best if these members can absorb well the upward force applied from the stacked currency bills BLC by allowing the lower pressing plate 43 etc. to move up and down relative to the upper pressing plate 41 etc. Preferably, it is best if the response speed of these members is fast so that these members can press the lower pressing plate 43 etc. against, and keep causing it to follow, the uppermost portion of the falling stacked currency bills BLC.

Furthermore, in the first embodiment, a case was described where, taking as a condition that the normal force P be greater than 0 when calculating the optimum spring constant K, the object E2 does not move away at all from the object E3—that is, the lower pressing plate 43 does not move away at all from the uppermost portion of the stacked currency bills BLC.

However, the present invention is not limited to this, and the object E2 may also be allowed to move away somewhat from the object E3 by setting a variety of conditions, such as the normal force P being greater than a predetermined negative constant, when calculating the spring constant K. In this case, it is best if a currency bill collapse can be substantially prevented by keeping small the distance and time in which the object E2 is away from the object E3 and keeping small the amount D3 that the currency bills BL in the uppermost portion of the stacked currency bills BLC stick out (see FIG. 15). The same also applies to the second to fifth embodiments.

Moreover, in the first embodiment, a case was described where the up and down direction length of the hole portions 43CX and the compressible length of the springs 44 from their natural state to their most compressed state were both greater than the projecting distance D1 (see FIG. 5) of the picker portions 23B of the picker rollers 23.

However, the present invention is not limited to this, and the length(s) of either one or both of these may also be shorter than the projecting distance D1. In this case, it is preferred that the amount of movement of the upper pressing plate 41 resulting from the transmission of force from the stacked currency bills BLC to the upper pressing plate 41 be kept as small as possible by keeping the difference with the projecting distance D1 as small as possible. The same also applies to the second to fifth embodiments.

Moreover, in the first embodiment, a case was described where the lower pressing plate 43 was configured to be able to rotate in the pitch direction about an axis running along the right and left direction and the yaw direction about an axis running along the front and rear direction (see FIG. 7 and FIG. 8).

However, the present invention is not limited to this, and the lower pressing plate 43 may also be configured so that it is not able to rotate in either one or both of the pitch direction and the yaw direction. In this case, in the currency bill feeder, the ability of the lower pressing plate 43 to follow the uppermost portion of the stacked currency bills BLC when the uppermost portion of the stacked currency bills BLC becomes inclined is diminished, but as long as the lower pressing plate 43 can follow the uppermost portion of the stacked currency bills BLC a certain extent by moving in the up and down direction, the currency bills BL in the uppermost portion of the stacked currency bills BLC can to a certain extent be kept from sticking out. Additionally, in the currency bill feeder, a currency bill collapse can be prevented although not completely. The same also applies to the second to fifth embodiments.

Moreover, in the first embodiment, a case was described where the claw-like portions 41BY of the upper pressing plate 41 were inserted through the four hole portions 43CX in the lower pressing plate 43 to regulate the movement of the lower pressing plate 43 in the front and rear direction. Additionally, in the first embodiment, a case was described where, by regulating the movement of the lower pressing plate 43 in the front and rear direction, the lower pressing plate 43 was not pulled rearward by the picker rollers 23 and the feed rollers 24.

However, the present invention is not limited to this and may also be configured in such a way that, for example, by ensuring that the range of movement of the hole portions 43CX and the claw-like portions 41BY in the front and rear direction is not regulated and forming a rear surface plate on the lower pressing plate 43 like in the second embodiment so that the rear surface plate is brought into contact with the mask guide 31, the lower pressing plate 43 is not pulled rearward.

Moreover, in the first embodiment, a case was described where the picker rollers 23 were configured by incorporating the picker portions 23B, whose frictional force is high, into the roller base portions 23A where the frictional force of the peripheral side surface is low.

However, the present invention is not limited to this; for example, each of the picker rollers 23 may also be entirely configured by a material whose frictional force is high, and the peripheral side surface outside the picker portion 23B may be reduced in diameter. Additionally, because of this reduction in diameter, picker rollers 23 configured in various ways—such as positioning the peripheral side surface outside the picker portion 23B under the floor guide 21 so that it does not contact the currency bills BL—may also be used. In this case, it is best if it can be ensured that the currency bills BL are picked out rearward by the picker portions 23B but are not picked out by the other peripheral side surfaces of the picker rollers 23. The same also applies to the second to fifth embodiments.

Moreover, in the first embodiment, a case was described where four picker rollers 23 were attached to the rotating shaft 23X.

However, the present invention is not limited to this and may also be configured in such a way that picker rollers 23 comprising an arbitrary number of rollers greater than one roller, such as two rollers or six rollers, are attached to the rotating shaft 23X. The same also applies to the second to fifth embodiments.

Moreover, in the first embodiment, a case was described where the currency bills BL serving as an example of media were stacked in the stacking space, placed on the floor guide 21, separated one at a time, and fed into the currency bill processing device 1.

However, the present invention is not limited to this and may also, for example, be applied to a variety of devices that stack a variety of paper sheet-like media, such as various tickets, securities, postcards, and envelopes, separate those media one at a time, and feed them inside. The same also applies to the second to fifth embodiments.

Moreover, in the first embodiment, a case was described where the currency bill feeder 5 serving as an example of a media feeding device was configured by the floor guide 21 serving as an example of a floor guide, the picker rollers 23 serving as an example of rollers, the mask guide 31 serving as an example of a mask guide, the upper pressing plate 41 serving as an example of a pressing member, the lower pressing plate 43 serving as an example of an auxiliary pressing member, and the springs 44 serving as an example of absorbing members.

However, the present invention is not limited to this, and the media feeding device may also be configured by a floor guide, rollers, a mask guide, a pressing member, an auxiliary pressing member, and absorbing members comprising a variety of other configurations.

Industrial Applicability

The present invention can be utilized in a variety of devices that separate and feed paper sheet-like media such as currency bills one at a time from a stacked state.

The entire disclosure of Japanese Patent Application No. 2012-087216 is incorporated herein by reference. All publications, patent applications, and technical standards described in the present specification are incorporated herein by reference to the same extent as if each publication, patent application, or technical standard was specifically and individually indicated to be incorporated by reference.

The invention claimed is:

1. A media feeding device comprising:

a floor guide on which paper sheet-like media are stacked and placed into a stack, and which is inclined in such a way that a feed direction side thereof, that feeds the media in the lowermost portion of the stack, is lower than another side of the floor guide;

rollers, each of which has a roller base portion formed in a substantially cylindrical shape and a picker portion that is disposed on part of a peripheral side surface of the roller base portion and causes frictional force to act on the media, with the rollers rotating in such a way that the picker portions project toward the stacked media from a lower side of picker holes formed in the floor guide;

a mask guide that supports the stacked media on the feed direction side of the floor guide;

a pressing member that has a predetermined mass and utilizes the force of gravity to press the stacked media against the floor guide;

an auxiliary pressing member that is interposed between the pressing member and the stacked media;

absorbing members that absorb force applied to the auxiliary pressing member from the media;

regulating bodies disposed at left and right side edges of the pressing member at positions near a front of the pressing member and near a rear of the pressing member; and regulated bodies that extend upward and are disposed on the auxiliary pressing member at left and right side edges of the auxiliary pressing member near a front of the auxiliary pressing member and a rear of the auxiliary pressing member, each of the regulated bodies having a hole portion formed in a center of the regulated body, the regulating bodies being disposed in the hole portions, the media feeding device being configured to be able to move the auxiliary pressing member in upward and downward directions relative to the pressing member, to rotate the auxiliary pressing member in rightward and leftward directions, or to rotate the auxiliary pressing member in frontward and rearward directions.

2. The media feeding device according to claim 1, wherein the absorbing members comprise elastic bodies that temporarily absorb the force applied to the auxiliary pressing member from the media and cause a repelling force, corresponding to the force applied to the auxiliary pressing member, to act.

3. The media feeding device according to claim 2, wherein the absorbing members have a spring constant set in such a way that when vibration occurs in the media due to the rotation of the rollers, a drag force acting between the auxiliary pressing member and the media is maintained at a value greater than 0.

4. The media feeding device according to claim 1, wherein the absorbing members comprise plate springs bent by bend lines along the feed direction and the opposite direction thereof.

5. The media feeding device according to claim 1, wherein a range in which a distance between the pressing member and the auxiliary pressing member can change in accompaniment with the absorption of the force by the absorbing members is greater than an amplitude of vibration when vibration occurs in the media due to the rotation of the rollers.

6. The media feeding device according to claim 1, wherein the absorbing members allow an opposing surface of the auxiliary pressing member, that opposes the media, to be inclined from a direction opposing the floor guide and extends toward the feed direction or the opposite direction of the feed direction.

7. The media feeding device according to claim 1, wherein the absorbing members allow an opposing surface of the auxiliary pressing member, that opposes the media, to be inclined toward a direction intersecting both a stacking direction in which the media are stacked and the feed direction.

8. The media feeding device according to claim 1, wherein the absorbing members suppress movement of the auxiliary pressing member in the feed direction relative to the pressing member.

9. The media feeding device according to claim 1, wherein the regulating bodies regulates a relative range of movement between the regulating bodies and the regulated bodies.

10. The media feeding device according to claim 9, wherein the regulating bodies regulate a range of movement of the auxiliary pressing member in the feed direction.

11. The media feeding device according to claim 1, wherein the media feeding device is configured to be able to move the auxiliary pressing member in the upward and downward directions relative to the pressing member.

12. The media feeding device according to claim 1, wherein the media feeding device is configured to rotate the auxiliary pressing member in the rightward and leftward directions.

13. The media feeding device according to claim 1, wherein the media feeding device is configured to rotate the auxiliary pressing member in the frontward and rearward directions.

14. The media feeding device according to claim 1, wherein the media feeding device is configured to perform each of moving the auxiliary pressing member in the upward and downward directions relative to the pressing member, rotating the auxiliary pressing member in the rightward and leftward directions, and rotating the auxiliary pressing member in the frontward and rearward directions.

15. A media feeding device comprising:

a floor guide on which paper sheet-like media are stacked and placed into a stack, and which is inclined;

rollers that each have a roller base portion formed in a substantially cylindrical shape, and a picker portion that is disposed on a part of a peripheral side surface of the roller base portion, the picker portions causing frictional force to act on the media as the rollers rotate in such a way that the picker portions project toward the stacked media from a lower side of picker holes formed in the floor guide;

a mask guide that supports the stacked media on a feed direction side of the floor guide;

a pressing member that has a predetermined mass and utilizes the force of gravity to press the stacked media against the floor guide;

an auxiliary pressing member that is interposed between the pressing member and the stacked media;

absorbing members that absorb force applied to the auxiliary pressing member from the media;

regulating bodies disposed at left and right side edges of the pressing member at positions near a front of the pressing member and near a rear of the pressing member; and regulated bodies that extend upward and are disposed on the auxiliary pressing member at left and right side edges of the auxiliary pressing member near a front of the auxiliary pressing member and a rear of the auxiliary pressing member, each of the regulated bodies having a hole portion formed in a center of the regulated body, the regulating bodies being disposed in the hole portions, the media feeding device being configured to be able to rotate the auxiliary pressing member in rightward and leftward directions, or to rotate the auxiliary pressing member in frontward and rearward directions.

16. The media feeding device according to claim 15, wherein the media feeding device is configured to be able to move the auxiliary pressing member in upward and downward directions relative to the pressing member.

17. The media feeding device according to claim 15, wherein the media feeding device is configured to rotate the auxiliary pressing member in the rightward and leftward directions.

18. The media feeding device according to claim 15, wherein the media feeding device is configured to rotate the auxiliary pressing member in the frontward and rearward directions.

19. The media feeding device according to claim 15, wherein the media feeding device is configured to perform each of moving the auxiliary pressing member in upward and downward directions relative to the pressing member, rotating the auxiliary pressing member in the rightward and leftward directions, and rotating the auxiliary pressing member in the frontward and rearward directions.

* * * * *